US010687144B2

(12) United States Patent
Gejo et al.

(10) Patent No.: US 10,687,144 B2
(45) Date of Patent: Jun. 16, 2020

(54) FILTER GENERATION DEVICE AND FILTER GENERATION METHOD

(71) Applicant: JVCKENWOOD Corporation, Yokohama-shi, Kanagawa (JP)

(72) Inventors: Takahiro Gejo, Yokohama (JP); Hisako Murata, Yokohama (JP); Yumi Fujii, Yokohama (JP)

(73) Assignee: JVCKENWOOD Corporation, Yokohama-shi (JP)

( * ) Notice: Subject to any disclaimer, the term of this patent is extended or adjusted under 35 U.S.C. 154(b) by 0 days.

(21) Appl. No.: 16/540,857

(22) Filed: Aug. 14, 2019

(65) Prior Publication Data

US 2019/0373368 A1 Dec. 5, 2019

Related U.S. Application Data

(63) Continuation of application No. PCT/JP2017/045615, filed on Dec. 20, 2017.

(30) Foreign Application Priority Data

Feb. 15, 2017 (JP) ..... 2017-025707

(51) Int. Cl.
*H04R 5/027* (2006.01)
*H04R 1/40* (2006.01)
(Continued)

(52) U.S. Cl.
CPC ..... *H04R 5/027* (2013.01); *H04R 1/406* (2013.01); *H04R 3/04* (2013.01); *H04R 5/033* (2013.01);
(Continued)

(58) Field of Classification Search
CPC ..... H04R 5/027; H04R 1/406; H04R 5/033; H04R 3/04; H04S 2400/01; H04S 7/304; H04S 3/004; H04S 1/00
See application file for complete search history.

(56) References Cited

U.S. PATENT DOCUMENTS 5,696,831 A 12/1997 Inanaga et al.
2008/0144839 A1 6/2008 Yoshino et al.

FOREIGN PATENT DOCUMENTS

EP 2 455 768 A1 5/2012
JP 2002-135898 A 5/2002
(Continued)

*Primary Examiner* — Regina N Holder
(74) *Attorney, Agent, or Firm* — Procopio, Cory, Hargreaves & Savitch LLP

(57) ABSTRACT

A processor of a filter generation device according to this embodiment includes a first synchronous addition unit that generates a first synchronous addition signal, a second synchronous addition unit that performs synchronous addition of sound pickup signals acquired with a microphone worn on an object or a person other than a listener with a second number of synchronous additions larger than a first number of synchronous additions and thereby generates a second synchronous addition signal, a first transform unit that transforms the first and second synchronous addition signals into frequency domain data so as to acquire first and second spectrums corresponding to the first and second synchronous addition signals, a first correction unit that corrects data of a first spectrum in a correction band and thereby generates a third spectrum, and a first inverse transform unit that inversely transforms the third spectrum into time domain data.

8 Claims, 18 Drawing Sheets

(51) Int. Cl.

| | |
|---|---|
| ***H04R 3/04*** | (2006.01) |
| ***H04R 5/033*** | (2006.01) |
| ***H04S 1/00*** | (2006.01) |
| ***H04S 3/00*** | (2006.01) |
| ***H04S 7/00*** | (2006.01) |

(52) U.S. Cl.
CPC ..... *H04S 1/00* (2013.01); *H04S 3/004* (2013.01); *H04S 7/304* (2013.01); *H04S 2400/01* (2013.01)

(56) References Cited

FOREIGN PATENT DOCUMENTS

| | | | |
|---|---|---|---|
| JP | 2008-512015 | A | 4/2008 |
| JP | 4184420 | B2 | 11/2008 |
| WO | 2006/024850 | A2 | 3/2006 |

FILTER GENERATION DEVICE AND FILTER GENERATION METHOD

CROSS REFERENCE TO RELATED APPLICATION

This application is a Bypass Continuation of International Application No. PCT/JP2017/045615, filed on Dec. 20, 2017, which is based upon and claims the benefit of priority from Japanese patent application No. 2017-25707 filed on Feb. 15, 2017, the disclosure of which is incorporated herein in its entirety by reference.

BACKGROUND

The present invention relates to a filter generation device and a filter generation method.

Sound localization techniques include an out-of-head localization technique, which localizes sound images outside the head of a listener by using headphones. The out-of-head localization technique localizes sound images outside the head by canceling characteristics from the headphones to the ears and giving four characteristics from stereo speakers to the ears.

In out-of-head localization reproduction, measurement signals (impulse sounds etc.) that are output from 2-channel (which is referred to hereinafter as "ch") speakers are recorded by microphones (which can be also called "mic") placed on the listener's ears. Then, a processor generates filters based on sound pickup signals obtained by impulse response. The generated filters are convolved to 2-ch audio signals, thereby implementing out-of-head localization reproduction.

Patent Literature 1 (Published Japanese Translation of PCT International Publication for Patent Application, No. 2008-512015) discloses a method for acquiring a set of personalized room impulse responses. In Patent Literature 1, microphones are placed near the ears of a listener. Then, the left and right microphones record impulse sounds when driving speakers.

SUMMARY

Disturbances such as background noise and power supply noise occur during impulse response measurement. Therefore, the impulse response measurement process carries out impulse response measurement a plurality of times under the same conditions and then performs synchronous addition of sound pickup signals picked up by microphones (Patent Literature 2: Japanese Patent No. 4184420). It is thereby possible to eliminate the effect of disturbances and improve the S/N ratio. When performing synchronous addition, the effect of disturbances decreases as the number of synchronous additions is larger. However, a user needs to remain still without moving during measurement, and it is burdensome for the user to listen to a measurement sound many times.

A filter generation device according to this embodiment includes a microphone configured to pick up measurement signals output from a sound source that outputs measurement signals and acquire sound pickup signals, and a filter generation unit configured to generate a filter in accordance with transfer characteristics from the sound source to the microphone, wherein the filter generation unit includes a first synchronous addition unit configured to perform synchronous addition of the sound pickup signals acquired by the microphone worn by a listener with a first number of synchronous additions and thereby generate a first synchronous addition signal, a second synchronous addition unit configured to perform synchronous addition of the sound pickup signals acquired by the microphone worn on an object or a person other than the listener with a second number of synchronous additions larger than the first number of synchronous additions and thereby generate a second synchronous addition signal, a transform unit configured to transform the first and second synchronous addition signals into a frequency domain so as to acquire a first spectrum corresponding to the first synchronous addition signal and a second spectrum corresponding to the second synchronous addition signal, a correction unit configured to correct the first spectrum by using the second spectrum in a band with a specified frequency or lower and thereby generate a third spectrum, and an inverse transform unit configured to inversely transform the third spectrum into a time domain.

A filter generation method according to this embodiment is a filter generation method of generating a filter in accordance with transfer characteristics by picking up measurement signals output from a sound source by use of a microphone, the method including a step of performing synchronous addition of sound pickup signals acquired by the microphone worn by a listener with a first number of synchronous additions and thereby generating a first synchronous addition signal, a step of performing synchronous addition of the sound pickup signals acquired by the microphone worn on an object or a person other than the listener with a second number of synchronous additions larger than the first number of synchronous additions and thereby generating a second synchronous addition signal, a step of transforming the first and second synchronous addition signals into a frequency domain so as to acquire a first spectrum corresponding to the first synchronous addition signal and a second spectrum corresponding to the second synchronous addition signal, a step of correcting the first spectrum by using the second spectrum in a band with a specified frequency or lower and thereby generate a third spectrum, and a step of inversely transforming the third spectrum into time domain data.

DETAILED DESCRIPTION

In this embodiment, transfer characteristics from speakers to microphones are measured. Then, a filter generation device generates filters based on the measured transfer characteristics.

The overview of a sound localization process using the filters generated by the filter generation device according to this embodiment is described hereinafter. An out-of-head localization process, which is an example of a sound localization device, is described hereinbelow. The out-of-head localization process according to this embodiment performs out-of-head localization by using personal spatial acoustic transfer characteristics (which is also called a spatial acoustic transfer function) and ear canal transfer characteristics (which is also called an ear canal transfer function). The ear canal transfer characteristics are transfer characteristics from the entrance of the ear canal to the eardrum. In this embodiment, out-of-head localization is achieved by using the spatial acoustic transfer characteristics from speakers to a listener's ears and inverse characteristics of the ear canal transfer characteristics when headphones are worn.

An out-of-head localization device according to this embodiment is an information processor such as a personal computer, a smart phone, a tablet PC or the like, and it includes a processing means such as a processor, a storage means such as a memory or a hard disk, a display means such as a liquid crystal monitor, an input means such as a touch panel, a button, a keyboard and a mouse, and an output means with headphones or earphones.

First Embodiment

Figure 1:
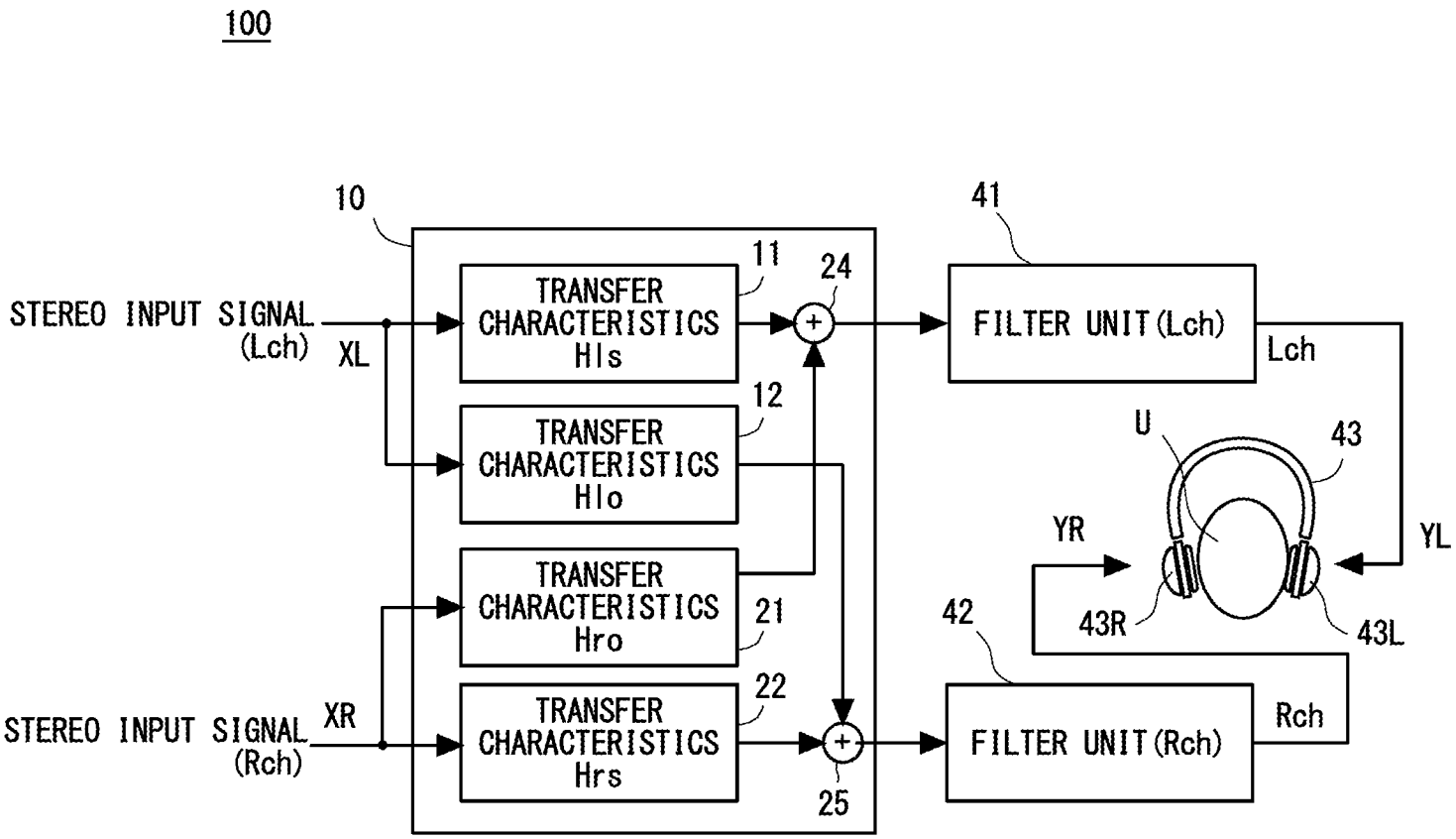
FIG. 1 is a block diagram showing an out-of-head localization device according to an embodiment.

FIG. 1 shows an out-of-head localization device 100, which is an example of a sound field reproduction device according to this embodiment. FIG. 1 is a block diagram of the out-of-head localization device. The out-of-head localization device 100 reproduces sound fields for a user U who is wearing headphones 43. Thus, the out-of-head localization device 100 performs sound localization for L-ch and R-ch stereo input signals XL and XR. The L-ch and R-ch stereo input signals XL and XR are analog audio reproduced signals that are output from a CD (Compact Disc) player or the like or digital audio data such as mp3 (MPEG Audio Layer-3). Note that the out-of-head localization device 100 is not limited to a physically single device, and a part of processing may be performed in a different device. For example, a part of processing may be performed by a personal computer or the like, and the rest of processing may be performed by a DSP (Digital Signal Processor) or the like included in the headphones 43.

The out-of-head localization device 100 includes an out-of-head localization unit 10, a filter unit 41, a filter unit 42, and headphones 43.

The out-of-head localization unit 10 includes convolution calculation units 11 to 12 and 21 to 22, and adders 24 and 25. The convolution calculation units 11 to 12 and 21 to 22 perform convolution processing using the spatial acoustic transfer characteristics. The stereo input signals XL and XR from a CD player or the like are input to the out-of-head localization unit 10. The spatial acoustic transfer characteristics are set to the out-of-head localization unit 10. The out-of-head localization unit 10 convolves the spatial acoustic transfer characteristics into each of the stereo input signals XL and XR having the respective channels. The spatial acoustic transfer characteristics may be a head-related transfer function HRTF measured in the head or auricle of the user U, or may be the head-related transfer function of a dummy head or a third person. Those transfer characteristics may be measured on sight, or may be prepared in advance.

The spatial acoustic transfer characteristics include filters in accordance with four transfer characteristics Hls, Hlo, Hro and Hrs. The filters in accordance with the four transfer characteristics can be obtained by using a filter generation device, which is described later.

The convolution calculation unit 11 convolves the filter in accordance with the transfer characteristics Hls to the L-ch stereo input signal XL. The convolution calculation unit 11 outputs convolution calculation data to the adder 24. The convolution calculation unit 21 convolves the filter in accordance with the transfer characteristics Hro to the R-ch stereo input signal XR. The convolution calculation unit 21 outputs convolution calculation data to the adder 24. The adder 24 adds the two convolution calculation data and outputs the data to the filter unit 41.

The convolution calculation unit 12 convolves the filter in accordance with the transfer characteristics Hlo to the L-ch stereo input signal XL. The convolution calculation unit 12 outputs convolution calculation data to the adder 25. The convolution calculation unit 22 convolves the filter in accordance with the transfer characteristics Hrs to the R-ch stereo input signal XR. The convolution calculation unit 22 outputs convolution calculation data to the adder 25. The adder 25 adds the two convolution calculation data and outputs the data to the filter unit 42.

An inverse filter that cancels out the headphone characteristics (characteristics between a reproduction unit of headphones and a microphone) is set to the filter units 41 and 42. Then, the inverse filter is convolved to the reproduced signals on which processing in the out-of-head localization unit 10 has been performed. The filter unit 41 convolves the inverse filter to the L-ch signal from the adder 24. Likewise, the filter unit 42 convolves the inverse filter to the R-ch signal from the adder 25. The inverse filter cancels out the characteristics from the headphone unit to the microphone when the headphones 43 are worn. The microphone may be placed at any position between the entrance of the ear canal and the eardrum. The inverse filter may be calculated from a result of measuring the characteristics of the user U on sight, or the inverse filter calculated from the headphone characteristics measured using an arbitrary outer ear such as a dummy head or the like may be prepared in advance.

The filter unit 41 outputs the corrected L-ch signal to a left unit 43L of the headphones 43. The filter unit 42 outputs the corrected R-ch signal to a right unit 43R of the headphones 43. The user U is wearing the headphones 43. The headphones 43 output the L-ch signal and the R-ch signal toward the user U. It is thereby possible to reproduce sound images localized outside the head of the user U.

Filter Generation Device

Figure 2:
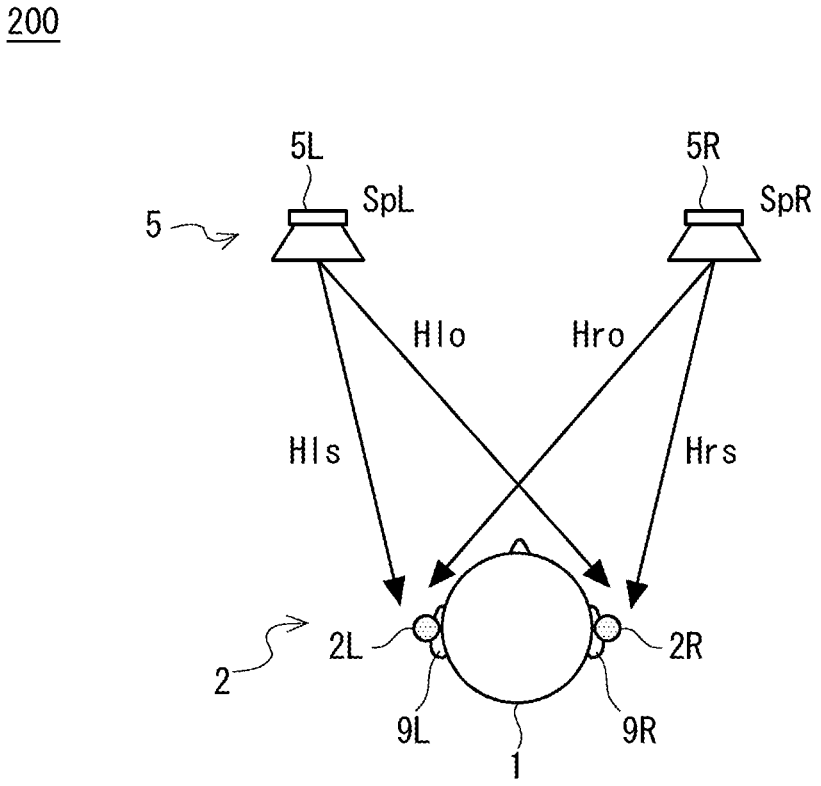
FIG. 2 is a view showing the structure of a filter generation device that generates a filter.

A filter generation device that measures spatial acoustic transfer characteristics (which are referred to hereinafter as transfer characteristics) and generates filters is described hereinafter with reference to FIG. 2. FIG. 2 is a view schematically showing the measurement structure of a filter generation device 200. Note that the filter generation device 200 may be a common device to the out-of-head localization device 100 shown in FIG. 1. Alternatively, a part or the whole of the filter generation device 200 may be a different device from the out-of-head localization device 100.

As shown in FIG. 2, the filter generation device 200 includes stereo speakers 5 and stereo microphones 2. The stereo speakers 5 are placed in a measurement environment. The measurement environment may be the user U's room at home, a dealer or showroom of an audio system or the like.

In this embodiment, a processor (not shown in FIG. 2) of the filter generation device 200 performs processing for appropriately generating filters in accordance with the transfer characteristics. The processor includes a music player such as an MP3 (MPEG-1 Audio Layer-3) player or a CD player, for example. The processor may be a personal computer (PC), a tablet terminal, a smart phone or the like.

The stereo speaker 5 includes a left speaker 5L and a right speaker 5R. For example, the left speaker 5L and the right speaker 5R are placed in front of a listener 1. The left speaker 5L and the right speaker 5R output impulse sounds for impulse response measurement and the like.

Although the number of speakers, which serve as sound sources, is 2 (stereo speakers) in this embodiment, the number of sound sources to be used for measurement is not limited to 2, and it may be 1 or more. Therefore, this embodiment is applicable also to 1 ch mono or 5.1 ch, 7.1 ch multichannel environment etc.

The stereo microphones 2 include a left microphone 2L and a right microphone 2R. The left microphone 2L is placed on a left ear 9L of the listener 1, and the right microphone 2R is placed on a right ear 9R of the listener 1. To be specific, the microphones 2L and 2R are preferably placed at the entrance of the ear canal or the eardrum of the left ear 9L and the right ear 9R, respectively. The microphones 2L and 2R pick up measurement signals output from the stereo speakers 5 and acquire sound pickup signals. For example, the measurement signal may be an impulse signal, a TSP (Time Stretched Pulse) signal or the like. The microphones 2L and 2R output the sound pickup signals to the filter generation device 200, which is described later. The listener 1 may be a person or a dummy head. In other words, in this embodiment, the listener 1 is a concept that includes not only a person but also a dummy head.

As described above, impulse responses are measured by measuring the impulse sounds output from the left and right speakers 5L and 5R by the microphones 2L and 2R, respectively. The filter generation device 200 stores the sound pickup signals acquired based on the impulse response measurement into a memory or the like. The transfer characteristics Hls between the left speaker 5L and the left microphone 2L, the transfer characteristics Hlo between the left speaker 5L and the right microphone 2R, the transfer characteristics Hro between the right speaker 5R and the left microphone 2L, and the transfer characteristics Hrs between the right speaker 5R and the right microphone 2R are thereby measured. Specifically, the left microphone 2L picks up the measurement signal that is output from the left speaker 5L, and thereby the transfer characteristics Hls are acquired. The right microphone 2R picks up the measurement signal that is output from the left speaker 5L, and thereby the transfer characteristics Hlo are acquired. The left microphone 2L picks up the measurement signal that is output from the right speaker 5R, and thereby the transfer characteristics Hro are acquired. The right microphone 2R picks up the measurement signal that is output from the right speaker 5R, and thereby the transfer characteristics Hrs are acquired.

Then, the filter generation device 200 generates filters in accordance with the transfer characteristics Hls, Hlo, Hro and Hrs from the left and right speakers 5L and 5R to the left and right microphones 2L and 2R based on the sound pickup signals. To be specific, the filter generation device 200 cuts out the transfer characteristics Hls, Hlo, Hro and Hrs with a specified filter length and performs arithmetic processing. In this manner, the filter generation device 200 generates filters to be used for convolution calculation of the out-of-head localization device 100. As shown in FIG. 1, the out-of-head localization device 100 performs out-of-head localization by using the filters in accordance with the transfer characteristics Hls, Hlo, Hro and Hrs between the left and right speakers 5L and 5R and the left and right microphones 2L and 2R. Specifically, the out-of-head localization is performed by convolving the filters in accordance with the transfer characteristics to the audio reproduced signals.

A study for improving the accuracy of characteristics obtained by measurement in a low-frequency band, which is a frequency band close to so-called background noise (standing wave, stationary wave) due to power supply noise, an air conditioner or the like, is described hereinafter. Detailed measurement by a dummy head and correction of characteristics data of each person using characteristics obtained by the measurement are studied below.

In order to reduce the effect of disturbances such as background noise or sudden noise described above, the filter generation device 200 carries out synchronous addition. The left speaker 5L or the right speaker 5R repeatedly outputs the same measurement signal at regular time intervals. Then, the left microphone 2L, right microphone 2R picks up a plurality of measurement signals, and synchronizes and adds sound pickup signals corresponding to the respective measurement signals. For example, when the number of synchronous additions is 16, the left speaker 5L or the right speaker 5R outputs the measurement signal 16 times. Then, the left microphone 2L, right microphone 2R synchronizes and adds 16 sound pickup signals. It is thereby possible to reduce effect of disturbances such as background noise or sudden noise and generate an appropriate filter.

The left speaker 5L or the right speaker 5R needs to output the next measurement signal without reverberation of the previous measurement signal or the like. It is thus necessary to set a certain length of time interval to output the measurement signal. Accordingly, an increase in the number of synchronous additions causes an increase in the entire measurement time. The listener 1 needs to remain still without moving during the measurement. When the listener 1 is the individual user U, it is burdensome for the user U to increase the measurement time. Therefore, in this embodiment, the number of synchronous additions is reduced in the measurement of an individual user.

On the other hand, an increase in the number of synchronous additions allows reduction of the effect of disturbances. In the measurement using a dummy head, it is not burdensome for the user U to increase the number of synchronous additions. Therefore, in this embodiment, the number of synchronous additions is different between the measurement using a dummy head and the measurement of an individual user.

For example, in the state where the stereo microphones 2 are worn on a dummy head as the listener 1, measurement is performed with the number of synchronous additions of 64. On the other hand, in the state where the stereo microphones 2 are worn on the actual user U, measurement is performed with the number of synchronous additions of 16. The measurement in the state where the stereo microphones 2 are worn on a dummy head is referred to as configuration measurement, and data based on the configuration measurement is referred to as configuration data. The measurement in the state where the microphones 2 are worn on the user U who actually does out-of-head localization listening is referred to as personal measurement, and data based on the personal measurement is referred to as personal measurement data. The filter generation device 200 corrects the personal measurement data by the configuration data.

To be specific, in a low-frequency band (which is also referred to as a correction band) that is lower than a correction upper limit frequency, the personal measurement data is corrected by the configuration data. For example, in the low-frequency band, a value of the personal measurement data (e.g., power or amplitude) is replaced by a value of the configuration data (e.g., power or amplitude). In a high-frequency band that is higher than the correction upper limit frequency, a value of the personal measurement data is used without any change. In this manner, the filter generation device 200 synthesizes the configuration data and the personal measurement data and thereby generates filters in accordance with the transfer characteristics. This embodiment corrects only a power spectrum without correcting a phase spectrum.

By setting the number of synchronous additions in personal measurement to be smaller than the number of synchronous additions in configuration measurement, it is possible to reduce the burden on a user. Specifically, by decreasing the number of synchronous additions of personal measurement, it is possible to shorten the measurement time for the user U to actually listen to the measurement signal. This reduces the burden on the user. Further, by increasing the number of synchronous additions of configuration measurement, it is possible to appropriately set the low-frequency band of the filter.

Figure 3:
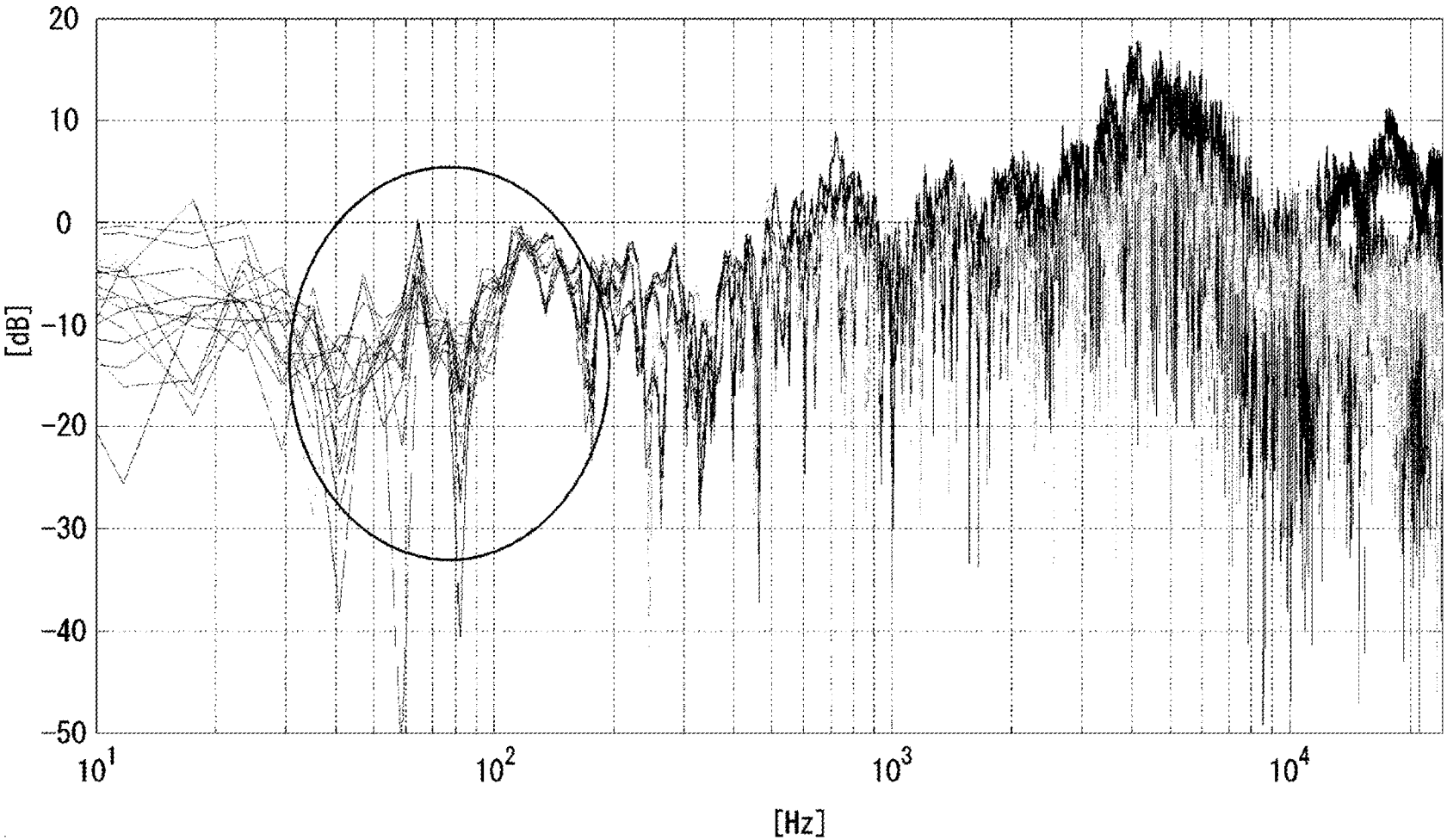
FIG. 3 is RAW data of logarithmic power spectrums of synchronous addition signals measured with the number of synchronous additions of 16 by using a dummy head.
Figure 4:
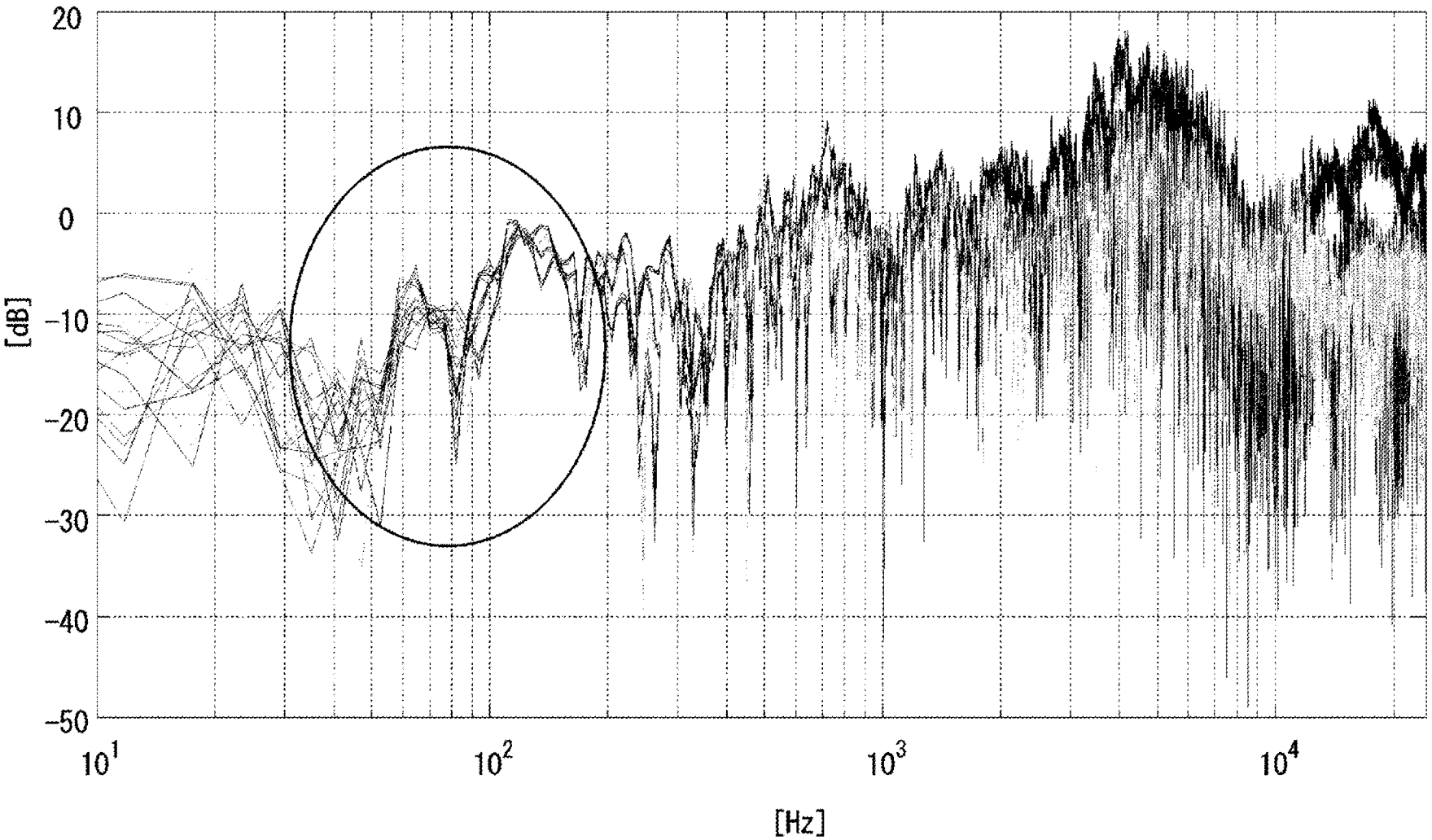
FIG. 4 is RAW data of logarithmic power spectrums of synchronous addition signals measured with the number of synchronous additions of 64 by using a dummy head.

A difference in measurement data depending on the number of synchronous additions is described hereinafter. FIG. 3 shows measurement data where the number of synchronous additions is 16, and FIG. 4 shows measurement data where the number of synchronous additions is 64. FIGS. 3 and 4 show logarithmic power spectrums obtained by analyzing synchronous addition signals after synchronous addition by fast Fourier transform (FFT). FIGS. 3 and 4 both show the measurement data when using a dummy head as the listener 1. In the measurement of this embodiment, a sampling frequency is 48 kHz, and a measurement frame length is 8192 samples. FIGS. 3 and 4 show logarithmic power spectrums of data of 8192 samples (which is referred to hereinafter as RAW data).

FIGS. 3 and 4 show logarithmic power spectrums of the four transfer characteristics Hls, Hlo, Hro and Hrs. FIG. 3 shows a result of carrying out 5 sets of measurement where 1 set includes 16 times of synchronous addition, and FIG. 4 shows a result of carrying out 5 sets of measurement where 1 set includes 64 times of synchronous addition. Thus, five logarithmic power spectrums are shown for the transfer characteristics Hls in each of FIGS. 3 and 4. Likewise, five logarithmic power spectrums are shown for each of the transfer characteristics Hlo, Hro and Hrs. Each of FIGS. 3 and 4 shows 20 logarithmic power spectrums.

As is obvious from a part enclosed in a circle in FIGS. 3 and 4, the transfer characteristics are more stable and thus more accurate when the number of synchronous additions is 64 than when the number of synchronous additions is 16 in the frequency band of about 40 Hz to 200 Hz. Specifically, when the number of synchronous additions is 16, there is a larger variation from set to set in the frequency band of about 40 Hz to 200 Hz as shown in FIG. 3.

Figure 5:
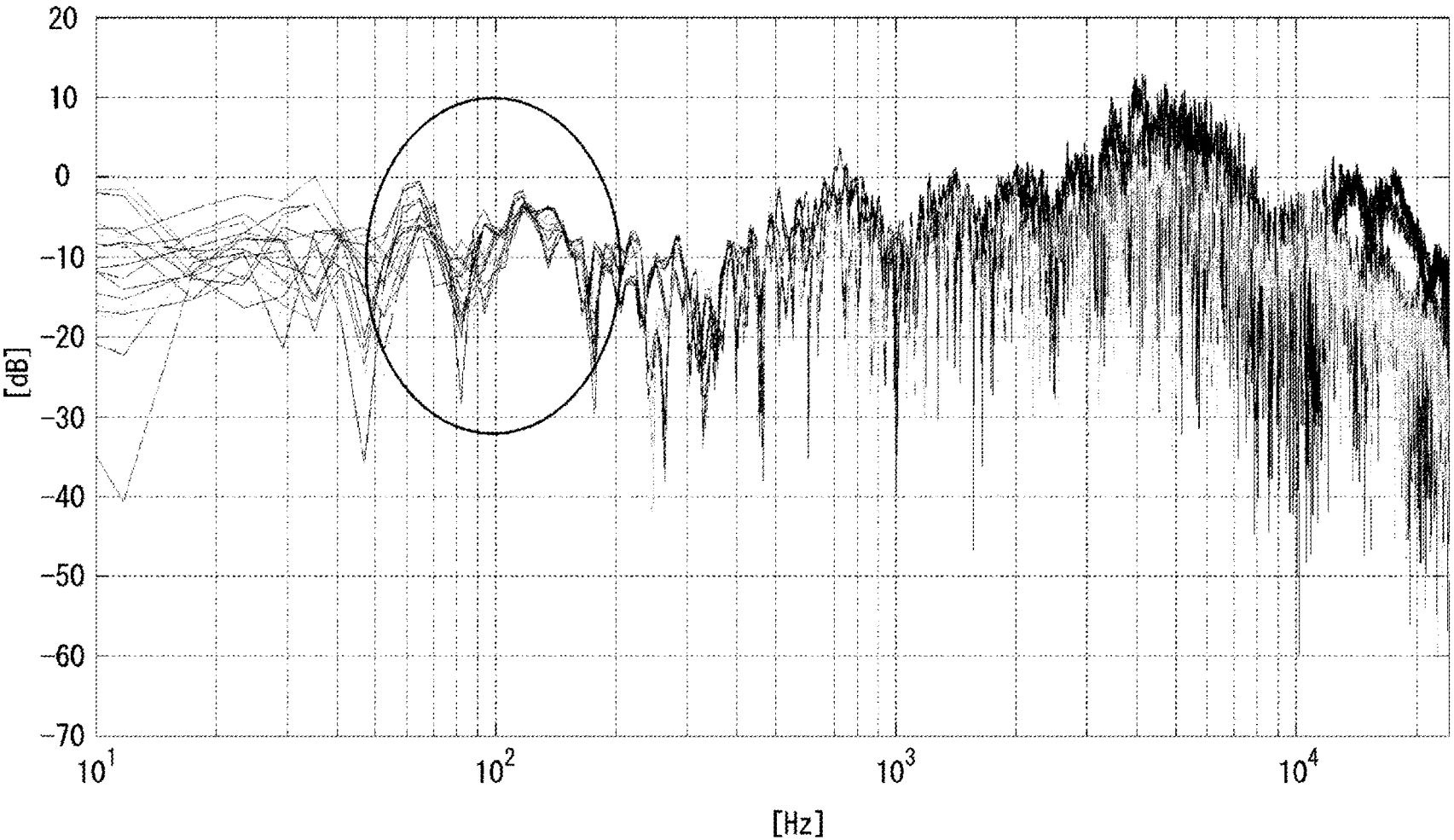
FIG. 5 is logarithmic power spectrums where processing is performed on synchronous addition signals measured with the number of synchronous additions of 16 by using a dummy head.
Figure 6:
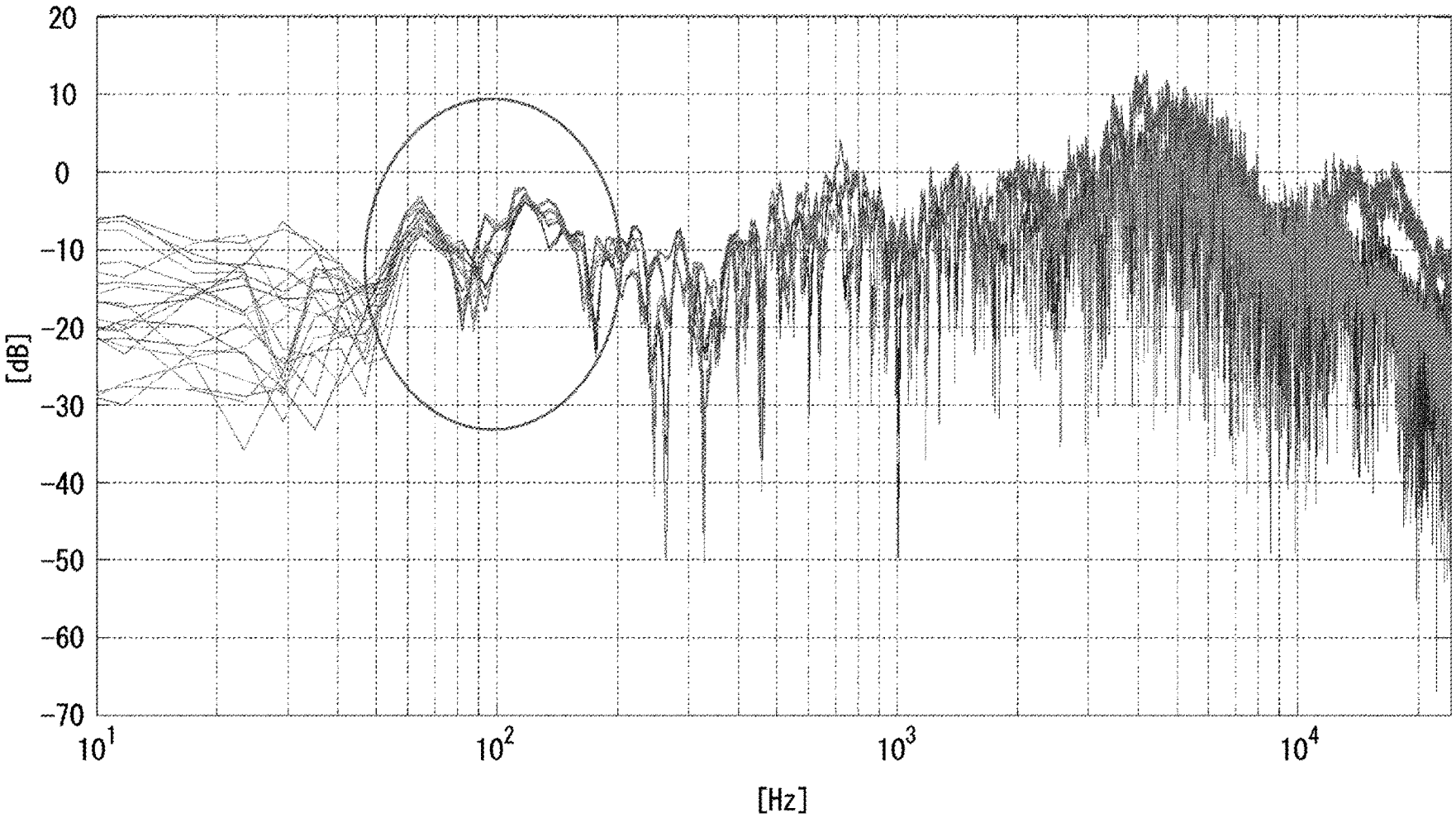
FIG. 6 is logarithmic power spectrums of synchronous addition signals measured with the number of synchronous additions of 64 by using a dummy head.

FIGS. 5 and 6 show logarithmic power spectrums of synchronous addition signals on which correction of microphone characteristics, filter cutout to a length of 4096 samples and windowing have been performed. FIG. 5 shows logarithmic power spectrums obtained by processing the measurement data where the number of synchronous additions is 16, which is RAW data corresponding to FIG. 3. FIG. 6 shows logarithmic power spectrums obtained by processing the measurement data where the number of synchronous additions is 64, which is RAW data corresponding to FIG. 4.

In this case also, as is obvious from a part enclosed in a circle in FIGS. 5 and 6, the transfer characteristics are more stable and thus more accurate when the number of synchronous additions is 64 than when the number of synchronous additions is 16 in the frequency band of about 40 Hz to 200 Hz. Specifically, when the number of synchronous additions is 16, there is a larger variation from set to set in the frequency band of about 40 Hz to 200 Hz as shown in FIG. 5.

Figure 7:
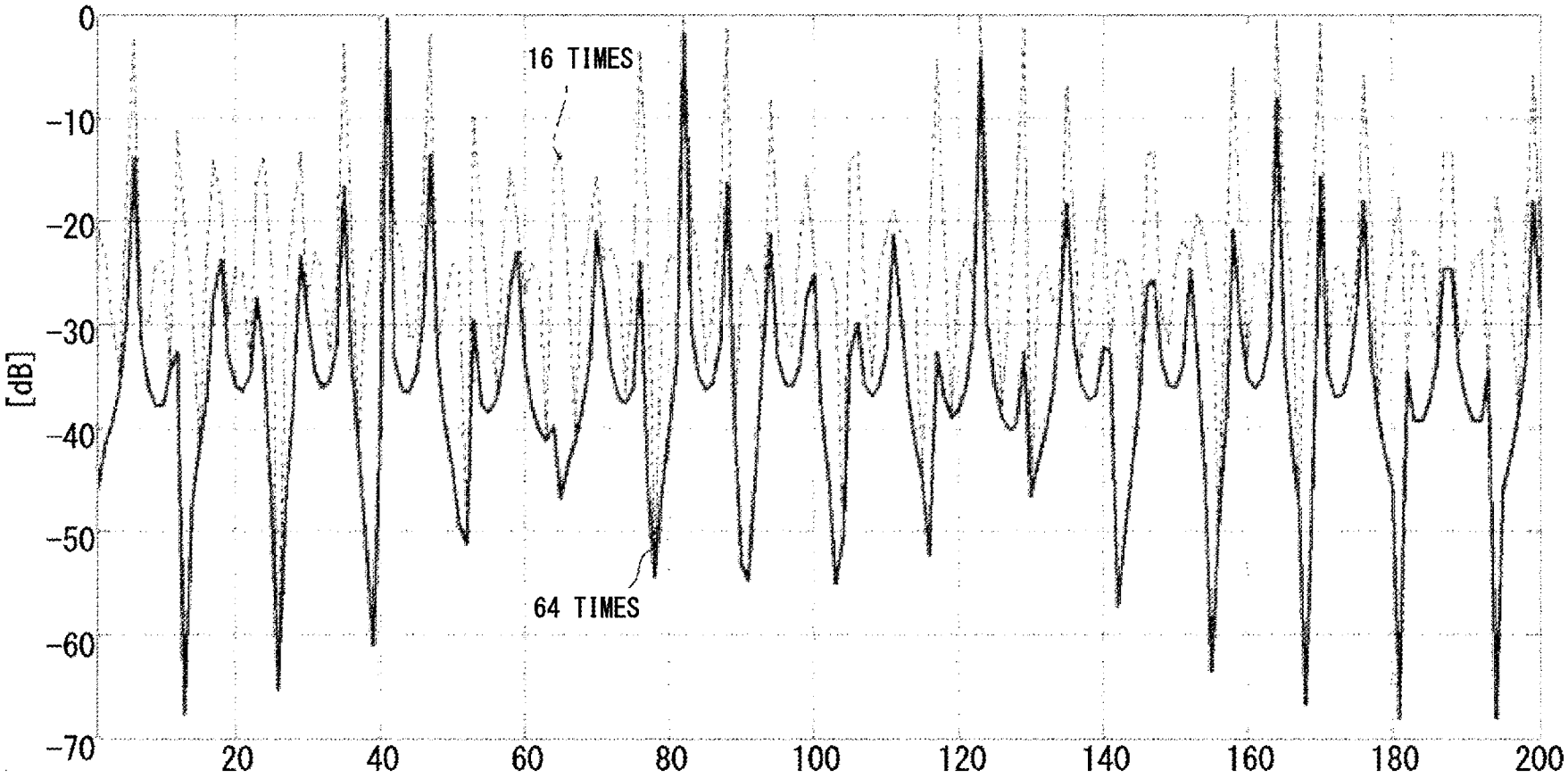
FIG. 7 is a graph showing a standing wave attenuation factor where the number of synchronous additions is 16 and 64.

FIG. 7 shows standing wave attenuation factors by synchronous addition. FIG. 7 shows a standing wave attenuation factor at every 1 Hz from a pure tone 1 Hz to 200 Hz in the case where a sampling frequency is 48 kHz and the number of samples in a synchronous frame is 8192. Further, FIG. 7 shows standing wave attenuation factors when the number of synchronous additions is 16 and 64. As shown therein, when the number of synchronous additions is 64, an attenuation factor of approximately −20 dB or more is obtained. Thus, standing waves due to disturbances are sufficiently attenuated when the number of synchronous additions is 64. Further, compared with the case where the number of synchronous additions is 16, improvement of several tens of dB is achieved as a whole when the number of synchronous additions is 64. Thus, it is possible to sufficiently reduce the effect of disturbances by setting the number of synchronous additions to 64 in the low-frequency band of 200 Hz or less.

To improve the measurement accuracy of the low-frequency band that is close to the frequency band of background noise, it is preferred to increase the number of synchronous additions. In this embodiment, the number of synchronous additions is increased in the low-frequency band by performing configuration measurement using a dummy head. By carrying out measurement of the transfer characteristics with a dummy head wearing the stereo microphones 2, it is possible to reduce the burden on a user even when the number of synchronous additions is large. Then, the filter generation device 200 corrects the personal measurement data by the configuration data.

Figure 8:
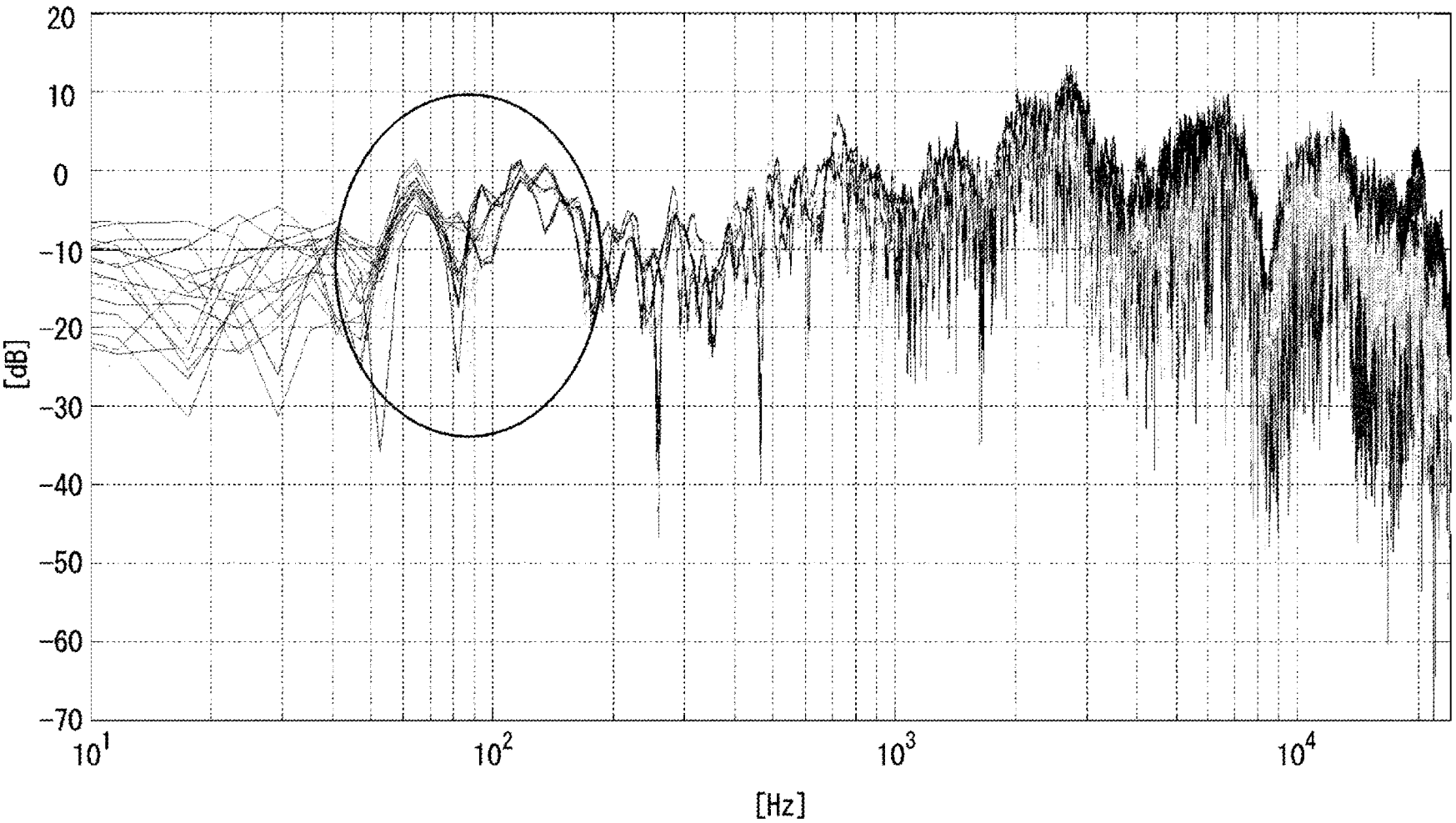
FIG. 8 is logarithmic power spectrums of synchronous addition signals measured with the number of synchronous additions of 64 in personal measurement.

FIG. 8 shows an example of personal measurement data. FIG. 8 is a graph showing a measurement result when the listener 1 is the user U. FIG. 8, like FIG. 6, shows logarithmic power spectrums obtained by analyzing, using FFT, data on which correction of microphone characteristics, filter cutout to a length of 4096 samples and windowing have been performed. FIG. 8 shows personal measurement data when the number of synchronous additions is 64.

A comparison of FIGS. 6 and 8 shows that the shape of logarithmic power spectrums in the low-frequency band is the same between configuration data and personal measurement data. In theory also, a head-related transfer function in the low-frequency band does not substantially differ from person to person. Thus, the shape of a logarithmic power spectrum in the low-frequency band does not exhibit individual variation depending on the user U. It is thus possible to correct the personal measurement data in the low-frequency band by the configuration data.

In the logarithmic power spectrums shown in FIGS. 6, 8 and the like, data is normalized in such a way that the sum of squares (=segmental power) of sample values in the time waveform of a synchronous addition signal is 1 in a larger one of the transfer characteristics Hls and Hrs. Specifically, normalization is done by multiplying the four transfer characteristics Hls, Hlo, Hro and Hrs by the same coefficient. However, as shown in the circles in FIGS. 6 and 8, a difference occurs in the level in the low-frequency band in spite of performing normalization.

In view of the above, it is preferred to make a level adjustment in accordance with configuration data and personal measurement data in an adjustment band in this embodiment. The adjustment band contains a higher frequency than a correction upper limit frequency. The adjustment band is 200 Hz to 500 Hz, for example. The details of the level adjustment are described later.

Figure 9:
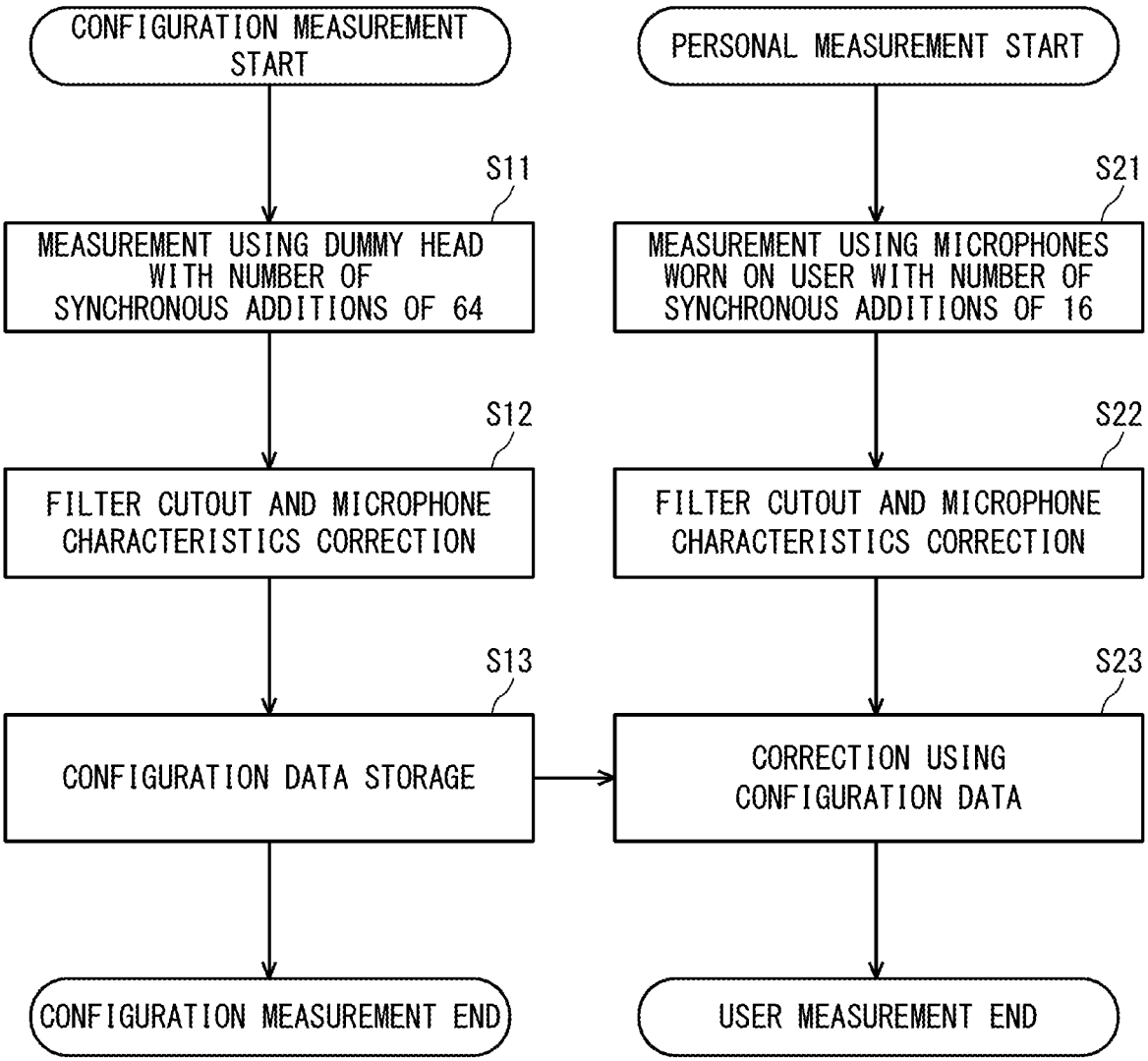
FIG. 9 is a flowchart showing the overview of a filter generation method.

A filter generation method according to this embodiment is described hereinafter reference to FIG. 9. FIG. 9 is a flowchart showing the overview of a filter generation method.

First, for configuration measurement, the filter generation device 200 performs measurement using a dummy head with the number of synchronous additions of 64 (S11). Specifically, in the measurement environment shown in FIG. 2, a dummy head is placed at a listening position, and the stereo microphones 2 are worn on the dummy head. The stereo speakers 5 output the same measurement signal 64 times. Then, 64 sound pickup signals picked up by the stereo microphones 2 are synchronized and added together. Synchronous addition signals respectively corresponding to the transfer characteristics Hls, Hlo, Hro and Hrs are thereby acquired.

Next, filter cutout is performed (S12). For example, filter cutout to a length of 4096 samples is performed as preprocessing on the synchronous addition signals acquired in S11. Because the synchronous addition signals are data of a sufficiently long time in consideration of echoes in a room or the like, the filter generation device 200 cuts it out to a data length of a necessary number of samples. Note that the filter generation device 200 may perform processing such as DC component cut, microphone characteristics correction and windowing as preprocessing on the cutout filter.

Then, the filter generation device 200 stores the preprocessed data as configuration data (S13). To be specific, the filter generation device 200 transforms the preprocessed configuration data into frequency domain data. The filter generation device 200 stores the frequency domain data as the configuration data. For example, the filter generation device 200 calculates logarithmic power spectrums and phase spectrums by performing FFT. The logarithmic power spectrums and the phase spectrums are then stored into a memory or the like as the configuration data.

After that, to acquire personal measurement data, the stereo microphones 2 are worn on the user U, and measurement is performed with the number of synchronous additions of 16 (S21). Specifically, the user U sits down at a listening position in the measurement environment shown in FIG. 2 and wears the stereo microphones 2. The stereo speakers 5 then output the same measurement signal 16 times. Then, 16 sound pickup signals picked up by the stereo microphones 2 are synchronized and added together. Synchronous addition signals respectively corresponding to the transfer characteristics Hls, Hlo, Hro and Hrs are thereby acquired.

Next, filter cutout is performed (S22). For example, filter cutout to a length of 4096 samples is performed as preprocessing on the synchronous addition signals acquired in S21. Because the synchronous addition signals are data of a sufficiently long time in consideration of echoes in a room or the like, the filter generation device 200 cuts it out to a data length of a necessary number of samples. Note that the filter generation device 200 may perform processing such as DC component cut, microphone characteristics correction and windowing as preprocessing on the cutout filter.

Then, the filter generation device 200 makes a correction of the personal measurement data by using the configuration data (S23). First, the filter generation device 200 transforms the personal measurement data preprocessed in S22 into frequency domain data. For example, the filter generation device 200 calculates logarithmic power spectrums and phase spectrums by performing FFT.

After that, the logarithmic power spectrums of the personal measurement data are corrected by the logarithmic power spectrums of the configuration data. To be specific, the filter generation device 200 replaces a power value of the personal measurement data with a power value of the configuration data in a low-frequency band lower than a correction upper limit frequency. The filter generation device 200 uses the power value of the personal measurement data without correction in a high-frequency band higher than the correction upper limit frequency. In this manner, the filter generation device 200 combines the power value of the configuration data in the low-frequency band lower and the power value of the personal measurement data in the high-frequency band and thereby generates corrected data.

Note that, when making a correction, the filter generation device 200 may adjust a level between the personal measurement data and the configuration data. To be specific, a level adjustment of the logarithmic power spectrums of the configuration data is made based on the logarithmic power spectrums of the personal measurement data and the configuration data in an adjustment band. The adjustment band is a band between a first frequency and a second frequency. The first frequency is higher than the second frequency and also higher than the above-described correction upper limit frequency. Although the second frequency is higher than the correction upper limit frequency in this example, the second frequency may be lower than the correction upper limit frequency.

Figure 10:
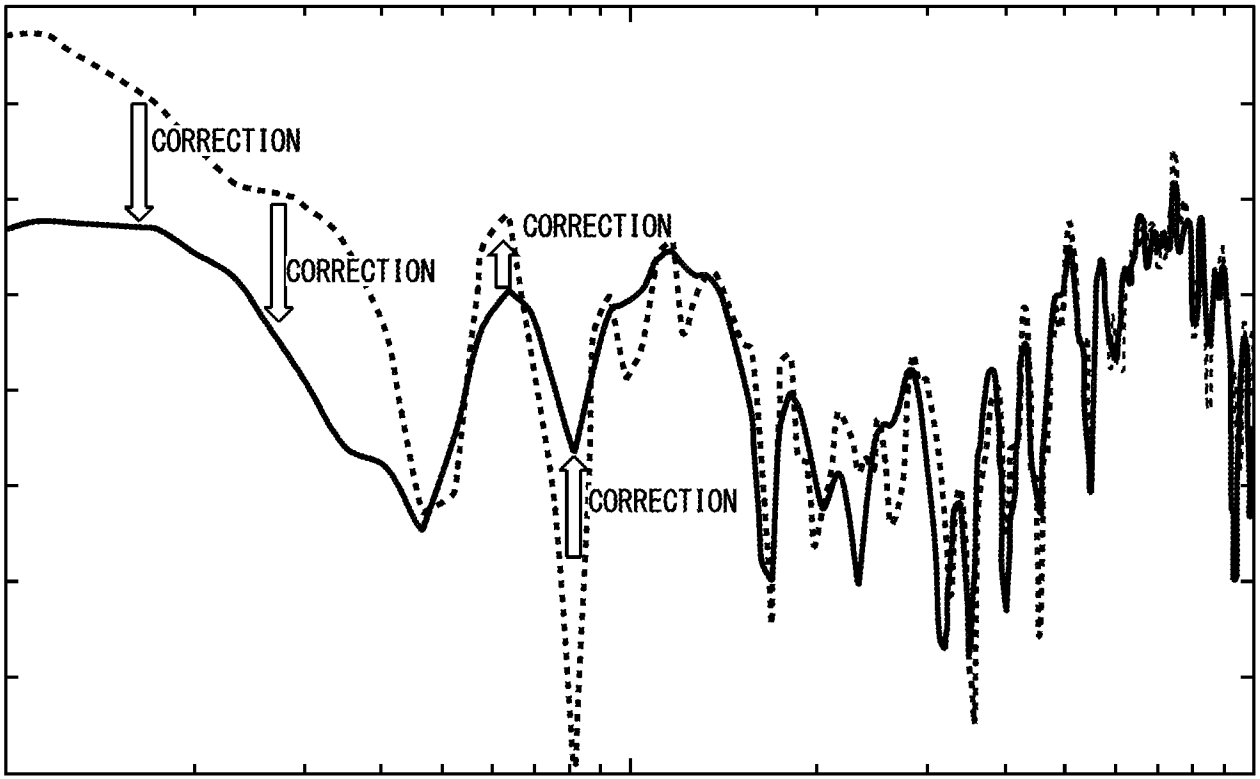
FIG. 10 is a graph showing logarithmic power spectrums before correction.
Figure 11:
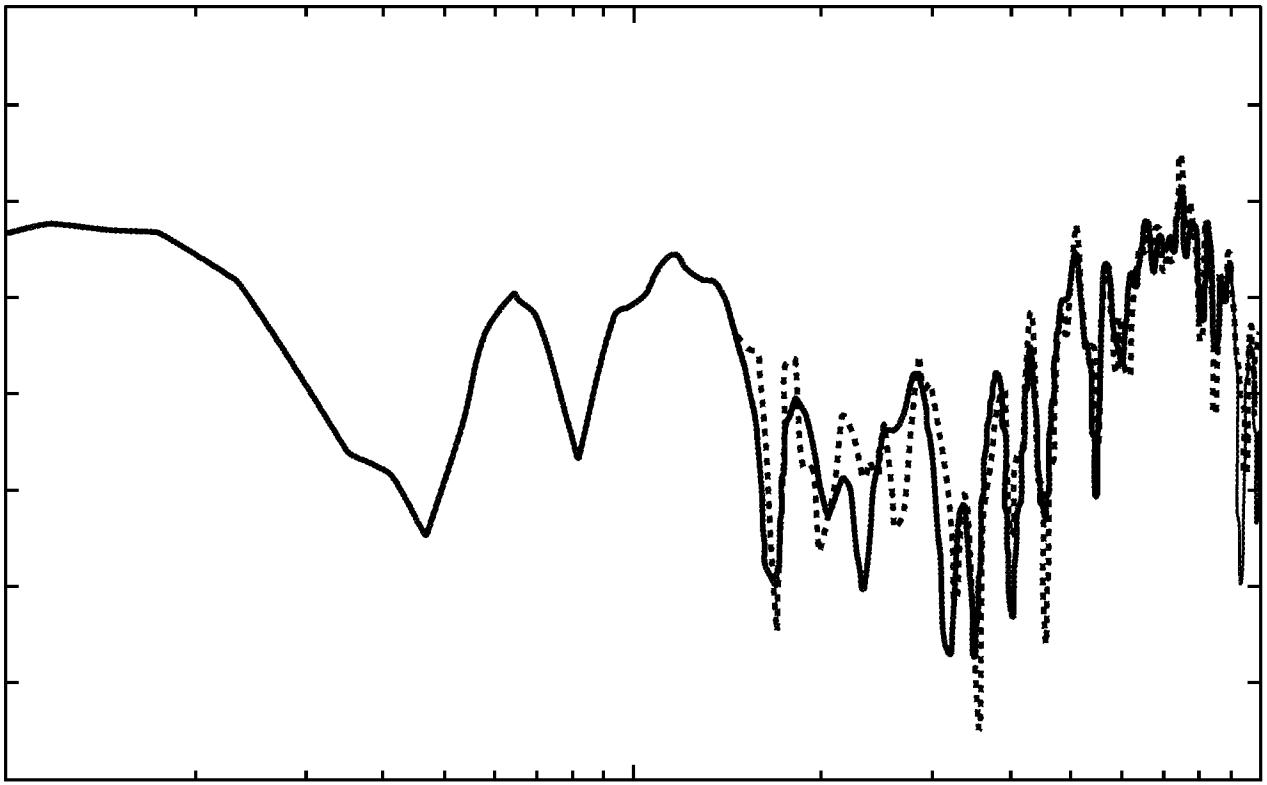
FIG. 11 is a graph showing logarithmic power spectrums after correction.

FIGS. 10 and 11 show an example of a logarithmic power spectrum before correction and a logarithmic power spectrum after correction. In FIG. 10, personal measurement data before correction is shown by a broken line, and configuration data is shown by a solid line. In FIG. 11, data after correction is shown by a broken line, and configuration data is shown by a solid line. In the low-frequency band, the corrected logarithmic power spectrum and the configuration measurement match.

In a specific example, the correction upper limit frequency is 150 Hz, the first frequency is 500 Hz, and the second frequency is 200 Hz. Accordingly, the adjustment band is 200 Hz to 500 Hz. The filter generation device 200 replaces a power value of less than 150 Hz in the personal measurement data with the configuration data. The low-frequency band in which the personal measurement data is corrected is a band from the lowest frequency up to 150 Hz. The high-frequency band in which the personal measurement data is not corrected is a band higher than the correction upper limit frequency. The correction upper limit frequency is preferably 100 Hz or higher and 200 Hz or lower.

Figure 12:
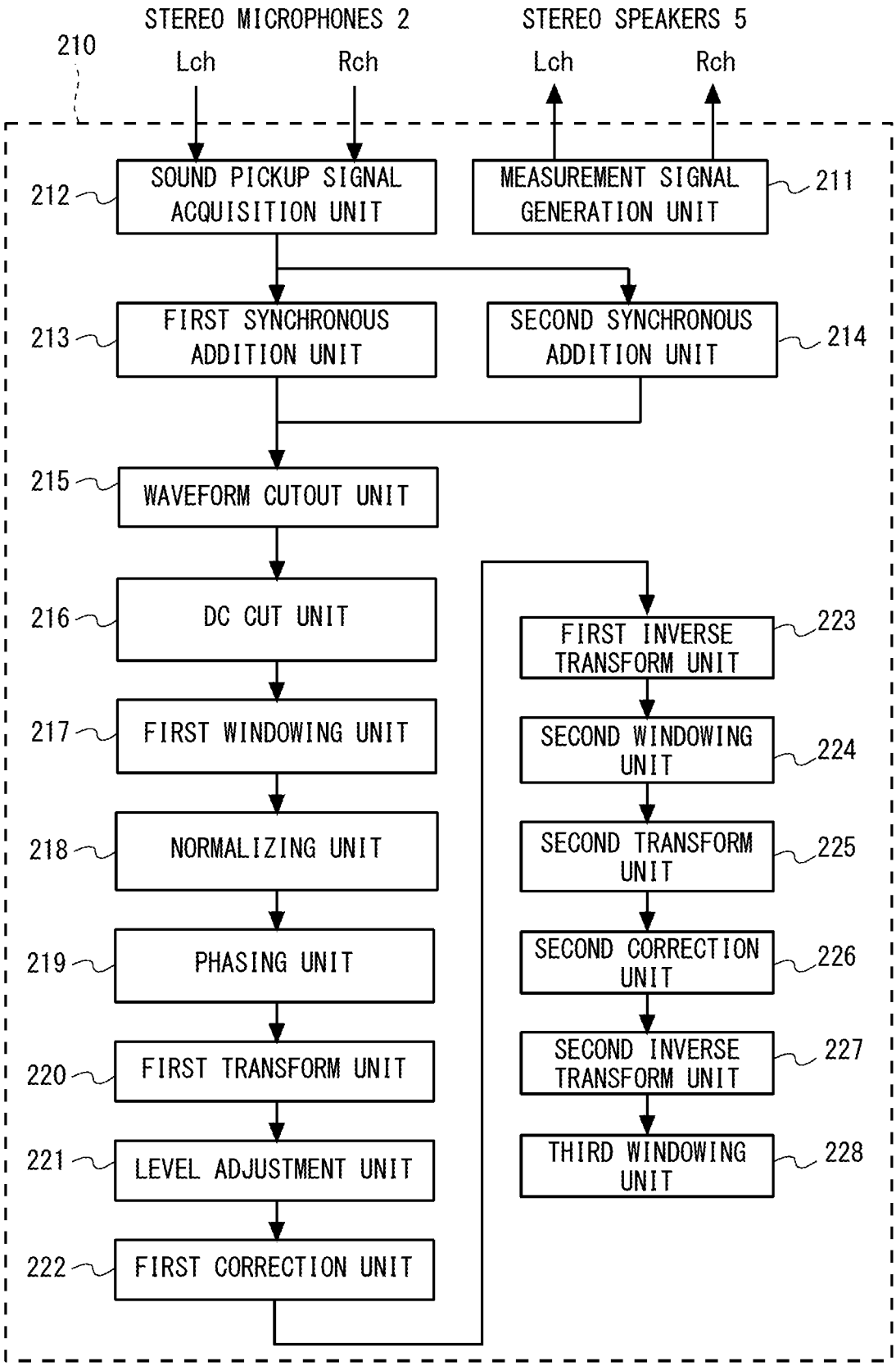
FIG. 12 is a control block diagram showing the structure of a filter generation device.
Figure 13:
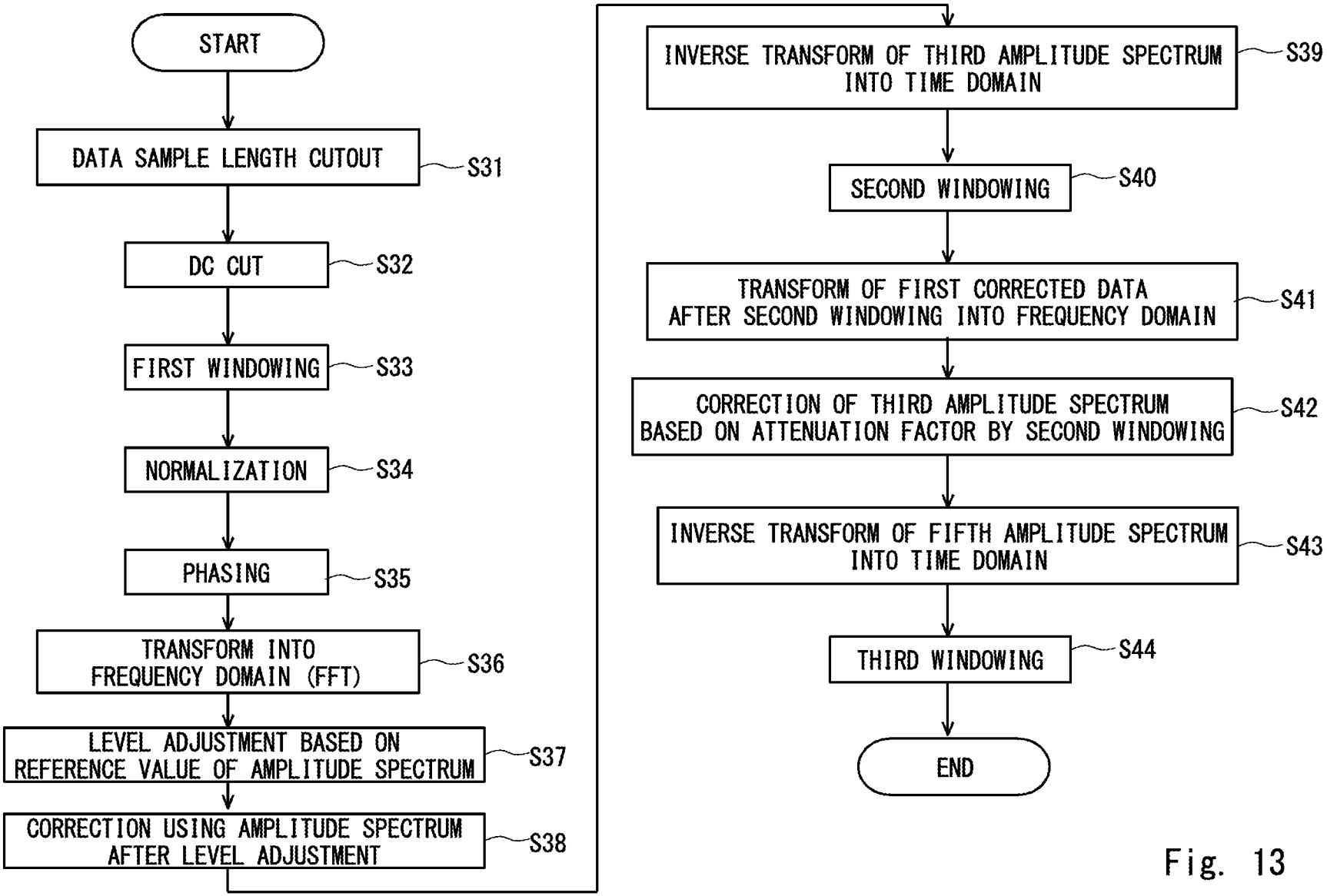
FIG. 13 is a flowchart showing a filter generation method.
Figure 14:
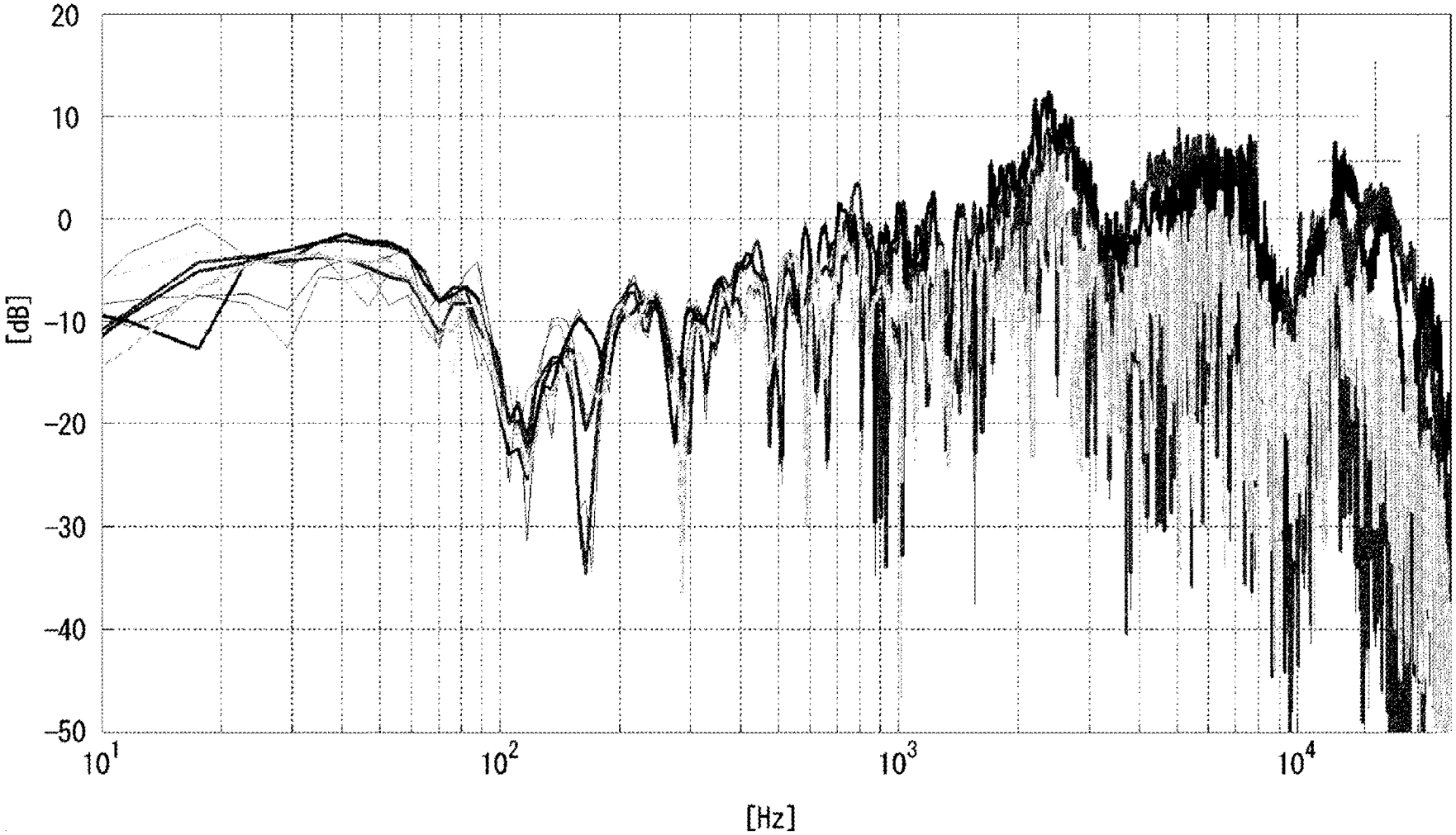
FIG. 14 is an example 1 showing logarithmic power spectrums in personal measurement and logarithmic power spectrums after correction.
Figure 15:
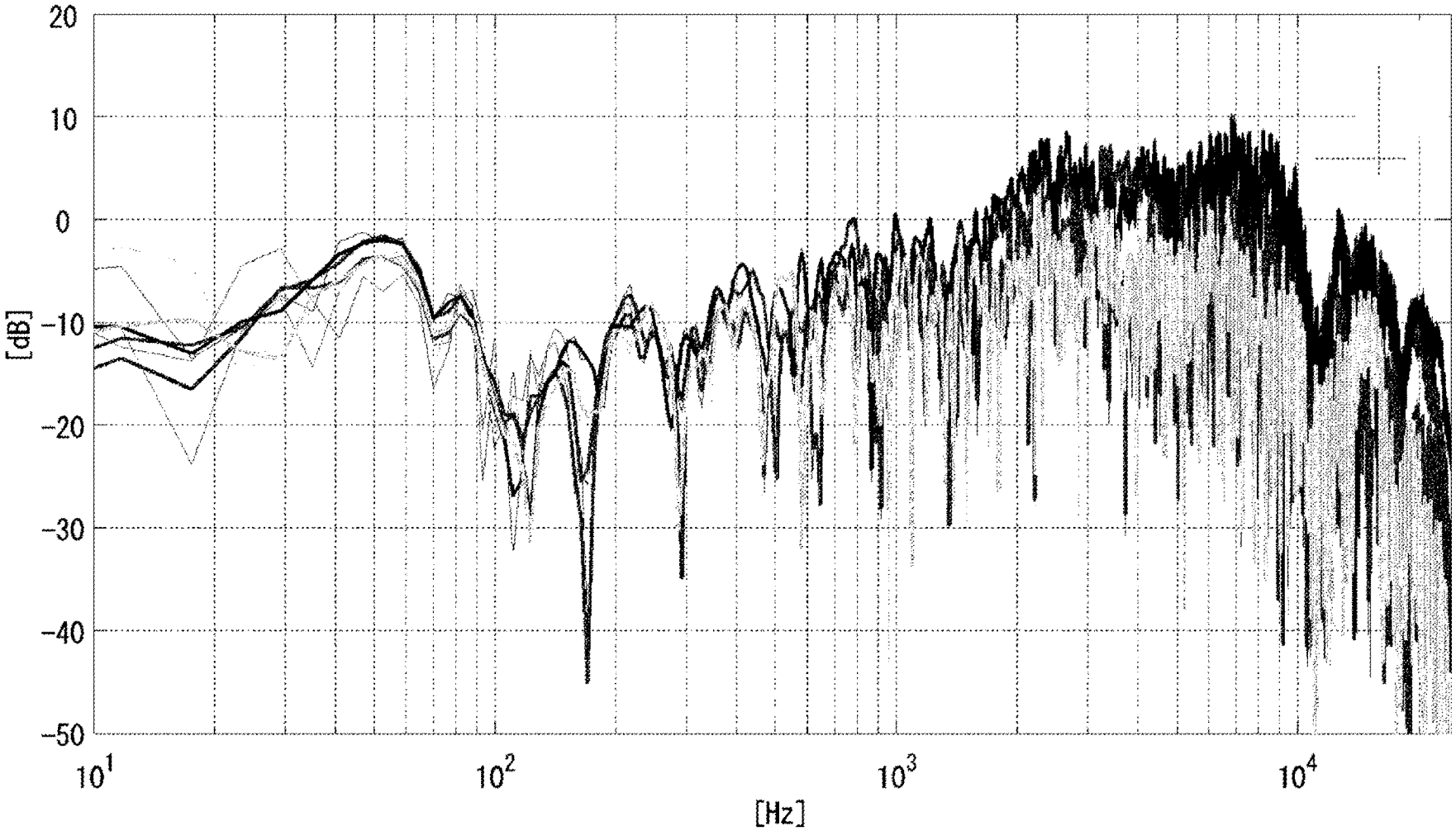
FIG. 15 is an example 2 showing logarithmic power spectrums in personal measurement and logarithmic power spectrums after correction.
Figure 16:
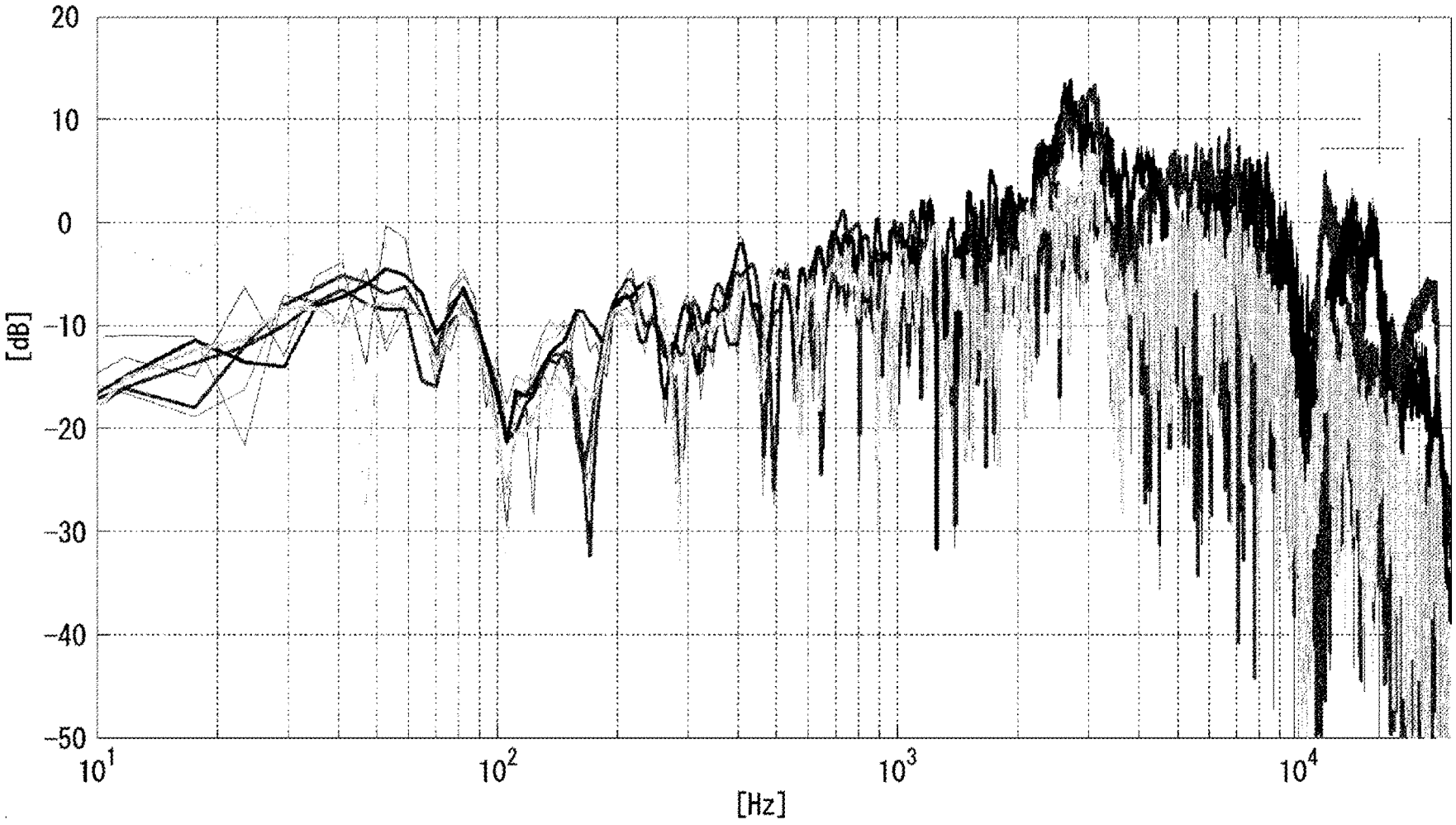
FIG. 16 is an example 3 showing logarithmic power spectrums in personal measurement and logarithmic power spectrums after correction.
Figure 17:
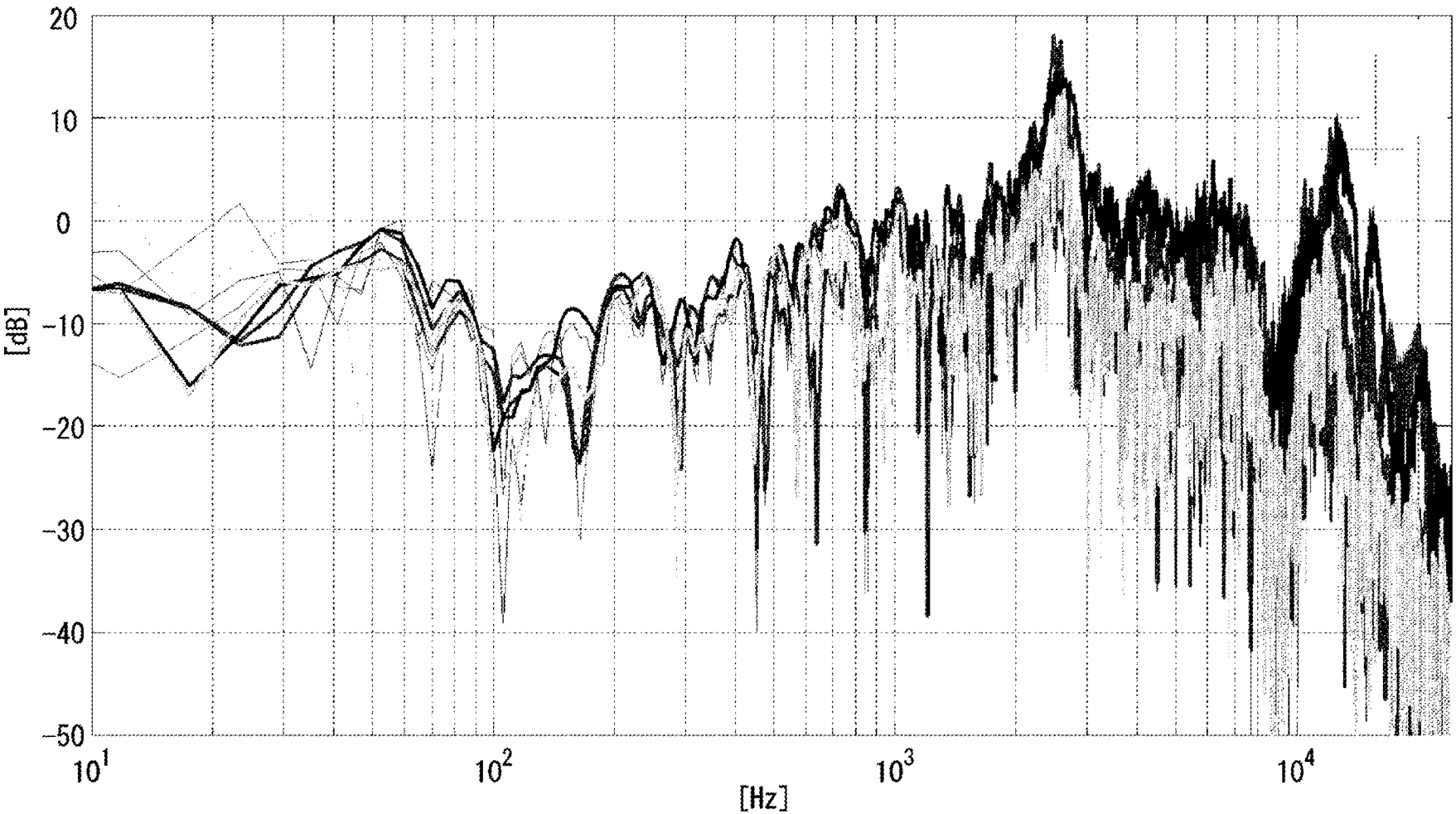
FIG. 17 is an example 4 showing logarithmic power spectrums in personal measurement and logarithmic power spectrums after correction.
Figure 18:
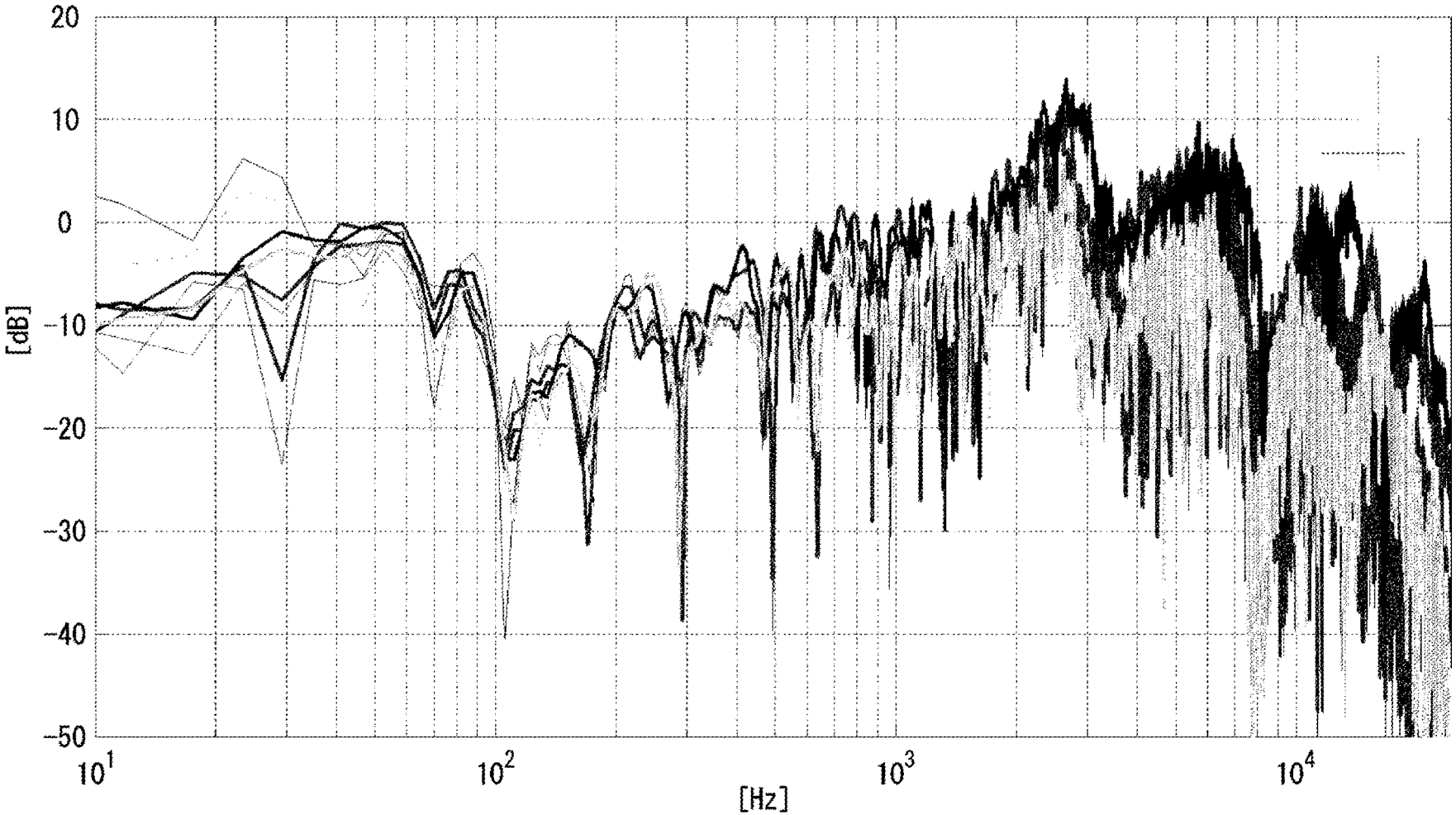
FIG. 18 is an example 5 showing logarithmic power spectrums in personal measurement and logarithmic power spectrums after correction.

A processor of the filter generation device 200 and its processing are described in detail hereinbelow. FIG. 12 is a control block diagram showing a processor 210 of the filter generation device 200. FIG. 13 is a flowchart showing a process in the processor 210.

The processor 210 functions as a filter generation device (filter generation unit). The processor 210 includes a measurement signal generation unit 211, a sound pickup signal acquisition unit 212, a first synchronous addition unit 213, a second synchronous addition 214, a waveform cutout unit 215, a DC cut unit 216, a first windowing unit 217, a normalizing unit 218, a phasing unit 219, a first transform unit 220, a level adjustment unit 221, a first correction unit 222, a first inverse transform unit 223, a second windowing unit 224, a second transform unit 225, a second correction unit 226, a second inverse transform unit 227, and a third windowing unit 228.

For example, the processor 210 is an information processor such as a personal computer, a smart phone, a tablet terminal or the like, and it includes an audio input interface (IF) and an audio output interface. Thus, the processor 210 is an acoustic device having input/output terminals connected to the stereo microphones 2 and the stereo speakers 5.

The measurement signal generation unit 211 includes a D/A converter, an amplifier and the like, and it generates a measurement signal. The measurement signal generation unit 211 outputs the generated measurement signal to each of the stereo speakers 5. Each of the left speaker 5L and the right speaker 5R outputs a measurement signal for measuring the transfer characteristics. Impulse response measurement by the left speaker 5L and impulse response measurement by the right speaker 5R are carried out, respectively. The measurement signal contains a measurement sound such as an impulse sound.

Each of the left microphone 2L and the right microphone 2R of the stereo microphones 2 picks up the measurement signal, and outputs the sound pickup signal to the processor 210. The sound pickup signal acquisition unit 212 acquires the sound pickup signals from the left microphone 2L and the right microphone 2R. Note that the sound pickup signal acquisition unit 212 includes an A/D converter, an amplifier and the like, and it may perform A/D conversion, amplification and the like of the sound pickup signals from the left microphone 2L and the right microphone 2R. The sound pickup signal acquisition unit 212 outputs the acquired sound pickup signals to the first synchronous addition unit 213 or the second synchronous addition 214.

In the case of personal measurement, the measurement signal generation unit 211 repeatedly outputs 16 measurement signals to the left speaker 5L or the right speaker 5R. Then, the sound pickup signal acquisition unit 212 outputs sound pickup signals corresponding to the 16 measurement signals to the first synchronous addition unit 213. The first synchronous addition unit 213 performs synchronous addition of the 16 sound pickup signals and thereby generates a first synchronous addition signal. The first synchronous addition unit 213 generates the synchronous addition signal for each of the transfer characteristics Hls, Hlo, Hro and Hrs.

In the case of configuration measurement, the measurement signal generation unit 211 repeatedly outputs 64 measurement signals to the left speaker 5L or the right speaker 5R. Then, the sound pickup signal acquisition unit 212 outputs sound pickup signals corresponding to the 64 measurement signals to the second synchronous addition 214. The second synchronous addition 214 performs synchronous addition of the 64 sound pickup signals and thereby generates a second synchronous addition signal. The second synchronous addition 214 generates the synchronous addition signal for each of the transfer characteristics Hls, Hlo, Hro and Hrs.

The first synchronous addition signal serves as personal measurement data, and the second synchronous addition signal serves as configuration data.

Next, the waveform cutout unit 215 cuts out a waveform with a necessary data sample length from the first and second synchronous addition signals (S31). To be specific, data with a length of 4096 samples is cut out from the first and second synchronous addition signals with a length of 8192 samples.

The DC cut unit 216 cuts DC components (direct-current components) of the first and second synchronous addition signals after the cutout (S32). This eliminates DC noise components in the first and second synchronous addition signals.

The first windowing unit 217 performs first windowing on the first and second synchronous addition signals after the DC component cut (S33). The window function multiplies the synchronous addition signal by a half of the window function with a different window length before and after the absolute maximum of the synchronous addition signal. The window function may be a hanning window or a hamming window, for example. Further, only a part at both ends, not the entire part, may be multiplied by the window function. The windowing function used in the first windowing unit 217 is not particularly limited.

Not that the processing from S31 to S33 is the same for the first synchronous addition signal and the second synchronous addition signal. Specifically, the cutout sample length and the window function are the same between the first synchronous addition signal and the second synchronous addition signal. An order of processing the first synchronous addition signal and the second synchronous addition signal is not particularly limited. The preprocessing of S31 to S33 may be performed on the first synchronous addition signal after the preprocessing of S31 to S33 is performed on the second synchronous addition signal. Alternatively, the preprocessing of S31 to S33 may be performed on the second synchronous addition signal after the preprocessing of S31 to S33 is performed on the first synchronous addition signal. In other words, the preprocessing of S31 to S33 may be performed on the first synchronous addition signal prior to the second synchronous addition signal, or the preprocessing of S31 to S33 may be performed on the second synchronous addition signal prior to the first synchronous addition signal.

Then, the normalizing unit 218 performs normalization on the synchronous addition signals after the windowing (S34). To be specific, the normalizing unit 218 calculates the sum of squares of data for each of the four synchronous addition signals of the transfer characteristics Hls, Hlo, Hro and Hrs. The normalizing unit 218 calculates a coefficient where the maximum value of the four sums of squares is 1. The normalizing unit 218 multiplies the four synchronous addition signals of the transfer characteristics Hls, Hlo, Hro and Hrs by this coefficient. For example, in the first synchronous addition signal, a coefficient K1 for the transfer characteristics Hls, Hlo, Hro and Hrs is the same value. In the second synchronous addition signal, a coefficient K2 for the transfer characteristics Hls, Hlo, Hro and Hrs is the same value.

The phasing unit 219 performs phasing of the first synchronous addition signal and the second synchronous addition signal after the normalization (S35). To be specific, the phasing unit 219 obtains a sample position with the absolute maximum for each of the transfer characteristics Hls, Hlo, Hro and Hrs. The phasing unit 219 then shifts the second synchronous addition signal in such a way that the sample position having the absolute maximum is the same between the first synchronous addition signal and the second synchronous addition signal.

For example, a case of performing phasing of the first synchronous addition signal of the transfer characteristics Hls and the second synchronous addition signal of the transfer characteristics Hls is described. It is assumed that the absolute maximum of the first synchronous addition signal of the transfer characteristics Hls is a sample position N1, and the absolute maximum of the second synchronous addition signal of the transfer characteristics Hls is a sample position N2. In this case, the second synchronous addition signal is shifted by (N1-N2) in such a way that the absolute maximums of the first synchronous addition signal and the second synchronous addition signal match at the sample position N1.

Likewise, for the transfer characteristics Hlo, the second synchronous addition signal is shifted in such a way that the absolute maximums of the first synchronous addition signal and the second synchronous addition signal match. For the transfer characteristics Hro, the second synchronous addition signal is shifted in such a way that the absolute maximums of the first synchronous addition signal and the second synchronous addition signal match. For the transfer characteristics Hrs, the second synchronous addition signal is shifted in such a way that the absolute maximums of the first synchronous addition signal and the second synchronous addition signal match. Note that a method of phasing is not limited to the above-described way, and a correlation between the first synchronous addition signal and the second synchronous addition signal or the like may be used, for example.

Then, the first transform unit 220 transforms the first and second synchronous addition signals after the phasing into frequency domain data (S36). The first transform unit 220 generates a first logarithmic power spectrum and a first phase spectrum of the first synchronous addition signal by using FFT. Likewise, the first transform unit 220 generates a second logarithmic power spectrum and a second phase spectrum of the second synchronous addition signal by using FFT.

The first logarithmic power spectrum and the first phase spectrum are personal measurement data, and the second logarithmic power spectrum and the second phase spectrum are configuration data. Note that the first transform unit 220 may generate an amplitude spectrum instead of the logarithmic power spectrum. Further, the first transform unit 220 may transform the synchronous addition signal into frequency domain data by discrete Fourier transform or discrete cosine transform.

The level adjustment unit 221 makes a level adjustment of the configuration data based on a reference value of the logarithmic power spectrum (S37). To be specific, the level adjustment unit 221 calculates reference values of the first logarithmic power spectrum and the second logarithmic power spectrum. The reference value is an average value of logarithmic power spectrums in a specified frequency range, for example. Note that the level adjustment unit 221 may exclude outliers of a certain value or more. Alternatively, the level adjustment unit 221 may restrict outliers of a certain value or more to a certain value. Note that a method of calculating the reference value is not limited thereto. For example, an average value of data on which cepstral smoothing, smoothing by moving average, straight-line approximation etc. or transform have been performed may be used as the reference value, or a median value of such data may be used as the reference value.

The level adjustment unit 221 calculates the reference value of the first logarithmic power spectrum as a first reference value, and calculates the reference value of the second logarithmic power spectrum as a second reference value. Then, the level adjustment unit 221 makes a level adjustment of the second logarithmic power spectrum based on the first reference value and the second reference value. To be specific, the power value of the second logarithmic power spectrum is adjusted in such a way that the second reference value matches the first reference value. For example, a coefficient K3 in accordance with a ratio of the first reference value and the second reference value is added to or subtracted from the second logarithmic power spectrum. Note that, in the case of using an amplitude spectrum instead of the logarithmic power spectrum, the amplitude value is adjusted by multiplication of the coefficient K3. A certain value regardless of a frequency can be used as the coefficient K3. In this manner, the level adjustment unit 221 makes a level adjustment of the second logarithmic power spectrum based on the first logarithmic power spectrum.

The first correction unit 222 corrects the first logarithmic power spectrum by using the second logarithmic power spectrum after the level adjustment (S38). To be specific, the power value of the first logarithmic power spectrum in the low-frequency band is replaced with the power value of the second logarithmic power spectrum. The logarithmic power spectrum shown in FIG. 10 is thereby corrected to the logarithmic power spectrum shown in FIG. 11. Note that the low-frequency band is a band lower than the correction upper limit frequency as described above. For example, because the correction upper limit frequency is 150 Hz, the low-frequency band is from the lowest frequency up to 150 Hz. In the high-frequency band higher than the correction upper limit frequency, the first correction unit 222 uses the power value of the first logarithmic power spectrum without correction. Note that the logarithmic power spectrum corrected by the first correction unit 222 is referred to also as first corrected data or a third logarithmic power spectrum.

The first inverse transform unit 223 inversely transforms the third logarithmic power spectrum into a time domain (S39). To be specific, the first inverse transform unit 223 inversely transforms the first corrected data into a time domain by using inverse fast Fourier transformation (IFFT).

For example, the first inverse transform unit 223 performs inverse discrete Fourier transform on the third logarithmic power spectrum and the first phase spectrum, and thereby the first corrected data becomes time domain data. The first inverse transform unit 223 may perform inverse transform by inverse discrete cosine transform or the like, instead of inverse discrete Fourier transform.

The second windowing unit 224 performs second windowing on the first corrected data after the inverse transform (S40). The second windowing is the same processing as the first windowing in S33, and the description thereof is omitted. A window function used in the second windowing may be the same as or different from the window function used in the first windowing.

The second transform unit 225 transforms the first corrected data after the second windowing into a frequency domain (S41). The second transform unit 225, like the first transform unit 220, transforms the first corrected data after the second windowing in the time domain into the first corrected data in the frequency domain. The logarithmic power spectrum and the phase spectrum calculated by the second transform unit 225 are referred to as a fourth logarithmic power spectrum and a fourth phase spectrum, respectively. The fourth logarithmic power spectrum and the fourth phase spectrum are the logarithmic power spectrum and the fourth phase spectrum after the second windowing.

Then, the second correction unit 226 corrects the third logarithmic power spectrum with use of an attenuation factor by the second windowing (S42). To be specific, the second correction unit 226 calculates an attenuation factor of the power of the third logarithmic power spectrum calculated in S38 and the fourth logarithmic power spectrum calculated in S41. The second correction unit 226 compares the first corrected data before and after the second windowing and calculates an attenuation factor of the power in a specified frequency band. Then, the second correction unit 226 makes a second correction on the third logarithmic power spectrum in accordance with the attenuation factor. Note that the logarithmic power spectrum corrected by the second correction unit 226 is referred to as a fifth logarithmic power spectrum or second corrected data.

A frequency band for calculating the attenuation factor is a band for calculation. The band for calculation is a part of the logarithmic power spectrum. The band for calculation can be calculated using the number of samples or a sampling rate of the synchronous addition signal. The band for calculation is a band in a lower frequency than a specified frequency. The band for calculation may be a different band from the low-frequency band or the same band as the low-frequency band.

The second correction unit 226 calculates the attenuation factor by the second windowing by comparing the power value of the third logarithmic power spectrum and the power value of the fourth logarithmic power spectrum in the band for calculation. Then, the second correction unit 226 raises the power value of the third logarithmic power spectrum in the band for calculation in accordance with the attenuation factor. For example, the power value of the third logarithmic power spectrum in the band for calculation is raised by addition or multiplication of a value in accordance with the attenuation factor to the power value of the third logarithmic power spectrum in the band for calculation. To be specific, the second correction unit 226 corrects the third logarithmic power spectrum in such a way that the attenuation factor of the fourth logarithmic power spectrum and the fifth logarithmic power spectrum is 1.

Then, the second inverse transform unit 227 inversely transforms the fifth logarithmic power spectrum into a time domain (S43). The second inverse transform unit 227 transforms the second corrected data into a time domain by performing inverse discrete Fourier transform or the like, which is the same as in S39. For example, the second inverse transform unit 227 performs inverse discrete Fourier transform on the fifth logarithmic power spectrum and the first phase spectrum, and thereby the second corrected data becomes time domain data. The second inverse transform unit 227 may perform inverse transform by inverse discrete cosine transform instead of inverse discrete Fourier transform.

Finally, the third windowing unit 228 performs windowing on the second corrected data in the time domain (S44). The third windowing unit 228 performs windowing by using the same window function as the windowing in S40. The process thereby ends.

By performing the above-described process, the processor 210 can generate filters in accordance with the transfer characteristics. The characteristics in the low-frequency band are difficult to eliminate the effect of background noise (standing wave, stationary wave) due to power supply noise, an air conditioner or the like having a close frequency band. Further, the characteristics in the low-frequency band do not substantially vary from individual to individual. Therefore, in the low-frequency band, the personal measurement data is replaced with the configuration data. It is thereby possible to appropriate generate filters in accordance with the transfer characteristics. The processor 210 generates a filter for each of the transfer characteristics Hls, Hlo, Hro and Hrs. Then, the filters generated by the processor 210 are set to the convolution calculation units 11, 12, 21 and 22 in FIG. 1. This achieves appropriate out-of-head localization.

The user U of the out-of-head localization device 100 only needs to perform simple measurement in a short time, and it is possible to reduce the burden on the user U. As a result of using the above-described filters, it is possible to improve the quality of reproduced sounds localized out-of head. This provides, in a sense of listening, the advantageous effects of (1) clarifying sound images in a low-frequency band remaining around the ears, (2) correcting left-right bias and reducing a sense of discomfort, (3) improving a sound pressure balance of middle and low frequencies and the like.

FIGS. 14 to 18 show logarithmic power spectrums of personal measurement data and logarithmic power spectrums after correction. FIGS. 14 to 18 show the logarithmic power spectrums of personal measurement data measured for five different users U and the logarithmic power spectrums after correction. In FIGS. 14 to 18, the wide lines indicate the logarithmic power spectrums after correction, and the narrow lines indicate the personal measurement spectrums before correction. The same configuration data is used in FIGS. 14 to 18. FIGS. 14 to 18 show that variation of characteristics in the low-frequency band is stabilized by the correction processing.

Note that, although the first correction unit 222 performs the first correction by replacing the power value in the low-frequency band, a method of correction is not particularly limited. A boundary frequency band may be set in close proximity to the correction upper limit frequency, and the power value may be corrected asymptotically in an exponential or linear fashion in the boundary frequency band.

For example, the correction upper limit frequency may be set to 200 Hz, and the boundary frequency band may be set to 200 Hz to 1 kHz. In the low-frequency band of 200 Hz or lower, the power value of the first logarithmic power spectrum is replaced with the power value of the second logarithmic power spectrum. At 1 kHz or higher, the power value of the first logarithmic power spectrum is used without correction. In the boundary frequency band (200 Hz to 1 kHz), the power value is set based on a function of asymptotically connecting the power value at 200 Hz and the power value at 1 kHz. This function may be an exponential function or a linear function.

Further, the correction upper limit frequency may be variable according to personal measurement. For example, a certain frequency width is specified, and a frequency point at which a difference between the first logarithmic power spectrum and the second logarithmic power spectrum is smallest is searched within the range of the frequency width. The obtained frequency point may be set as the correction upper limit frequency. For example, it is assumed that a search is made where the frequency width is 50 Hz, and a difference between the first logarithmic power spectrum and the second logarithmic power spectrum is smallest in the frequency width of 80 Hz to 130 Hz. In this case, the correction upper limit frequency can be set to 130 Hz.

Although the number of synchronous additions in configuration measurement is 64 and the number of synchronous additions in personal measurement is 16 in the above-described example, the number of synchronous additions is not limited thereto as long as the number of synchronous additions in configuration measurement is larger than the number of synchronous additions in personal measurement. The number of synchronous additions in personal measurement is 2 or more.

The personal measurement time is reduced by setting the number of synchronous additions in personal measurement to be smaller than the number of synchronous additions in configuration measurement. It is thereby possible to reduce the burden on the user U.

By using a dummy head, it is possible to increase the number of synchronous additions and thereby reduce the effect of disturbances or the like. Although the burden on the user U can be reduced by performing configuration measurement using a dummy head, the configuration measurement may be of a person different from the person (user U) who has performed personal measurement. In other words, configuration data of one person may be used for a plurality of users U. This also reduces the burden on the user U.

All of the processing performed in the processor 210 is not necessary. For example, a part or the whole of the processing of S31 to S34, the processing of S35 or the like may be omitted. Further, although performing the processing of S37 by the level adjustment unit 221 allows appropriate filter generation, this step is also omissible. A part or the whole of the processing of S40 to S44 or the like may be also omitted.

Note that the processor 210 is not limited to a single physical device. A part of the processing of the processor 210 may be performed in another device. For example, configuration data measured in another device is prepared. Then, the processor 210 stores the second logarithmic power spectrum of the configuration data into a memory or the like. By storing the configuration data in the memory in advance, it is possible to use this data for correction of personal measurement data of a plurality of users U.

A part or the whole of the above-described processing may be executed by a computer program. The above-described program can be stored and provided to the computer using any type of non-transitory computer readable medium. The non-transitory computer readable medium includes any type of tangible storage medium. Examples of the non-transitory computer readable medium include magnetic storage media (such as floppy disks, magnetic tapes, hard disk drives, etc.), optical magnetic storage media (e.g. magneto-optical disks), CD-ROM (Read Only Memory), CD-R, CD-R/W, DVD-ROM (Digital Versatile Disc Read Only Memory), DVD-R (DVD Recordable)), DVD-R DL (DVD-R Dual Layer)), DVD-RW (DVD ReWritable)), DVD-RAM), DVD+R), DVR+R DL), DVD+RW), BD-R (Blu-ray (registered trademark) Disc Recordable)), BD-RE (Blu-ray (registered trademark) Disc Rewritable)), BD-ROM), and semiconductor memories (such as mask ROM, PROM (Programmable ROM), EPROM (Erasable PROM), flash ROM, RAM (Random Access Memory), etc.). The program may be provided to a computer using any type of transitory computer readable medium. Examples of the transitory computer readable medium include electric signals, optical signals, and electromagnetic waves. The transitory computer readable medium can provide the program to a computer via a wired communication line such as an electric wire or optical fiber or a wireless communication line.

Although embodiments of the invention made by the present invention are described in the foregoing, the present invention is not restricted to the above-described embodiments, and various changes and modifications may be made without departing from the scope of the invention.

The present application is applicable to a filter generation device that generates a filter in accordance with transfer characteristics.

What is claimed is:

1. A filter generation device comprising:

a microphone configured to pick up measurement signals output from a sound source that outputs measurement signals and thereby acquire sound pickup signals; and a filter generation unit configured to generate a filter in accordance with transfer characteristics from the sound source to the microphone, wherein the filter generation unit includes a first synchronous addition unit configured to perform synchronous addition of the sound pickup signals acquired by the microphone worn by a listener with a first number of synchronous additions and thereby generate a first synchronous addition signal, a second synchronous addition unit configured to perform synchronous addition of the sound pickup signals acquired by the microphone worn on an object or a person other than the listener with a second number of synchronous additions larger than the first number of synchronous additions and thereby generate a second synchronous addition signal, a transform unit configured to transform the first and second synchronous addition signals into a frequency domain so as to acquire a first spectrum corresponding to the first synchronous addition signal and a second spectrum corresponding to the second synchronous addition signal, a correction unit configured to correct the first spectrum by using the second spectrum in a band with a specified frequency or lower and thereby generate a third spectrum, and an inverse transform unit configured to inversely transform the third spectrum into a time domain.

2. The filter generation device according to claim 1, further comprising:

an adjustment unit configured to adjust a level of the second spectrum by using data contained in a band between a first frequency higher than the specified frequency and a second frequency lower than the first frequency, wherein the correction unit corrects data of the first spectrum in the band with the specified frequency or lower by using data of the second spectrum adjusted by the adjustment unit.

3. The filter generation device according to claim 1, wherein the correction unit replaces the data of the first spectrum in the band with the specified frequency or lower with the data of the second spectrum.

4. The filter generation device according to claim 1, wherein the second synchronous addition unit adds the sound pickup signals acquired by the microphone worn on a dummy head and thereby generates the second synchronous addition signal.

5. A filter generation method of generating a filter in accordance with transfer characteristics by picking up measurement signals output from a sound source by use of a microphone, comprising:

a step of performing synchronous addition of sound pickup signals acquired by the microphone worn by a listener with a first number of synchronous additions and thereby generating a first synchronous addition signal, a step of performing synchronous addition of the sound pickup signals acquired by the microphone worn on an object or a person other than the listener with a second number of synchronous additions larger than the first number of synchronous additions and thereby generating a second synchronous addition signal, a step of transforming the first and second synchronous addition signals into a frequency domain so as to acquire a first spectrum corresponding to the first synchronous addition signal and a second spectrum corresponding to the second synchronous addition signal, a step of correcting the first spectrum by using the second spectrum in a band with a specified frequency or lower and thereby generate a third spectrum, and a step of inversely transforming the third spectrum into time domain data.

6. The filter generation method according to claim 5, further comprising:

a step of adjusting a level of the second spectrum by using data contained in a band between a first frequency higher than the specified frequency and a second frequency lower than the first frequency, wherein the step of correcting corrects the first spectrum in the band with the specified frequency or lower by using the second spectrum with an adjusted level.

7. The filter generation method according to claim 5, wherein the step of correcting replaces data of the first spectrum in the band with the specified frequency or lower by data of the second spectrum.

8. The filter generation method according to claim 5, wherein the second synchronous addition signal is generated by adding the sound pickup signals acquired by the microphone worn on a dummy head.

* * * * *